US010453666B2

(12) United States Patent
Welkie

(10) Patent No.: US 10,453,666 B2
(45) Date of Patent: Oct. 22, 2019

(54) RF ION GUIDE WITH AXIAL FIELDS

(71) Applicant: PerkinElmer Health Sciences, Inc., Waltham, MA (US)

(72) Inventor: David G. Welkie, Trumbull, CT (US)

(73) Assignee: PerkinElmer Health Sciences, Inc., Waltham, MA (US)

( * ) Notice: Subject to any disclaimer, the term of this patent is extended or adjusted under 35 U.S.C. 154(b) by 0 days.

(21) Appl. No.: 16/042,531

(22) Filed: Jul. 23, 2018

(65) Prior Publication Data

US 2019/0043705 A1 Feb. 7, 2019

Related U.S. Application Data

(63) Continuation of application No. 15/445,891, filed on Feb. 28, 2017, now Pat. No. 10,032,617, which is a continuation of application No. 14/734,916, filed on Jun. 9, 2015, now Pat. No. 9,613,788.

(60) Provisional application No. 62/011,953, filed on Jun. 13, 2014.

(51) Int. Cl.

| | |
|---|---|
| ***H01J 49/06*** | (2006.01) |
| ***H01J 49/00*** | (2006.01) |
| ***H01J 49/40*** | (2006.01) |

(52) U.S. Cl.

CPC ..... *H01J 49/063* (2013.01); *H01J 49/0031* (2013.01); *H01J 49/0045* (2013.01); *H01J 49/062* (2013.01); *H01J 49/40* (2013.01); *H01J 49/005* (2013.01)

(58) Field of Classification Search

CPC ..... H01J 49/0027; H01J 49/0031; H01J 49/0045; H01J 49/005; H01J 49/06; H01J 49/062; H01J 49/063; H01J 49/40

See application file for complete search history.

(56) References Cited

U.S. PATENT DOCUMENTS

| | | | | |
|---|---|---|---|---|
| 6,674,071 | B2 * | 1/2004 | Franzen | H01J 9/062 250/292 |
| 7,067,802 | B1 | 6/2006 | Kovtoun | |
| 7,868,289 | B2 | 1/2011 | Cousins | |

(Continued)

OTHER PUBLICATIONS

International Search Report and Written Opinion issued in PCT/US2015/034886 dated Sep. 14, 2015 (10 pages).

(Continued)

*Primary Examiner* — David E Smith

(74) *Attorney, Agent, or Firm* — Fish & Richardson P.C.

(57) ABSTRACT

RF ion guides are configured as an array of elongate electrodes arranged symmetrically about a central axis, to which RF voltages are applied. The RF electrodes include at least a portion of their length that is semi-transparent to electric fields. Auxiliary electrodes are then provided proximal to the RF electrodes distal to the ion guide axis, such that application of DC voltages to the auxiliary electrodes causes an auxiliary electric field to form between the auxiliary electrodes and the ion guide RF electrodes. A portion of this auxiliary electric field penetrates through the semi-transparent portions of the RF electrodes, such that the potentials within the ion guide are modified. The auxiliary electrode structures and voltages can be configured so that a potential gradient develops along the ion guide axis due to this field penetration, which provides an axial motive force for collision damped ions.

15 Claims, 27 Drawing Sheets

(56) References Cited

U.S. PATENT DOCUMENTS

| | | | | |
|---|---|---|---|---|
| 9,613,788 | B2 | 4/2017 | Welkie | |
| 2001/0035498 | A1 | 11/2001 | Li et al. | |
| 2002/0148972 | A1 | 10/2002 | Krutchinsky | |
| 2004/0004185 | A9 | 1/2004 | Guevremont et al. | |
| 2004/0011956 | A1 | 1/2004 | Londry et al. | |
| 2004/0094709 | A1 | 5/2004 | Bateman | |
| 2004/0149902 | A1 | 8/2004 | Park | |
| 2007/0176090 | A1 | 8/2007 | Verentchikov | |
| 2008/0014656 | A1 | 1/2008 | Thomson | |
| 2008/0265154 | A1* | 10/2008 | Cousins | H01J 49/063 250/288 |
| 2009/0045062 | A1 | 2/2009 | Senko et al. | |
| 2009/0166534 | A1 | 7/2009 | Collings | |
| 2010/0108879 | A1* | 5/2010 | Bateman | G01N 27/622 250/283 |
| 2010/0294923 | A1 | 11/2010 | Kenny et al. | |
| 2010/0301210 | A1 | 12/2010 | Bertsch et al. | |
| 2010/0327157 | A1 | 12/2010 | Green et al. | |
| 2011/0006203 | A1 | 1/2011 | Fujita | |
| 2011/0133079 | A1 | 6/2011 | Cousins et al. | |
| 2011/0147584 | A1 | 6/2011 | Kim et al. | |
| 2011/0192969 | A1* | 8/2011 | Verentchikov | H01J 49/062 250/282 |
| 2011/0266434 | A1 | 11/2011 | Li et al. | |
| 2012/0091334 | A1 | 4/2012 | Guna | |
| 2012/0228492 | A1 | 9/2012 | Franzen | |
| 2012/0248307 | A1 | 10/2012 | Ding et al. | |
| 2013/0175440 | A1 | 7/2013 | Perelman | |
| 2013/0206973 | A1* | 8/2013 | Kovtoun | H01J 49/063 250/282 |
| 2014/0131567 | A1 | 5/2014 | Makarov | |
| 2014/0151546 | A1 | 6/2014 | Li et al. | |

OTHER PUBLICATIONS

Extended European Search Report issued in EP15805976.6 dated Jan. 5, 2018 (11 pages).

* cited by examiner

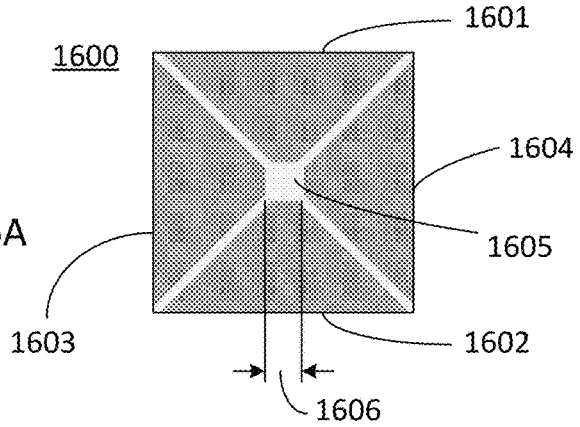
FIG. 16A
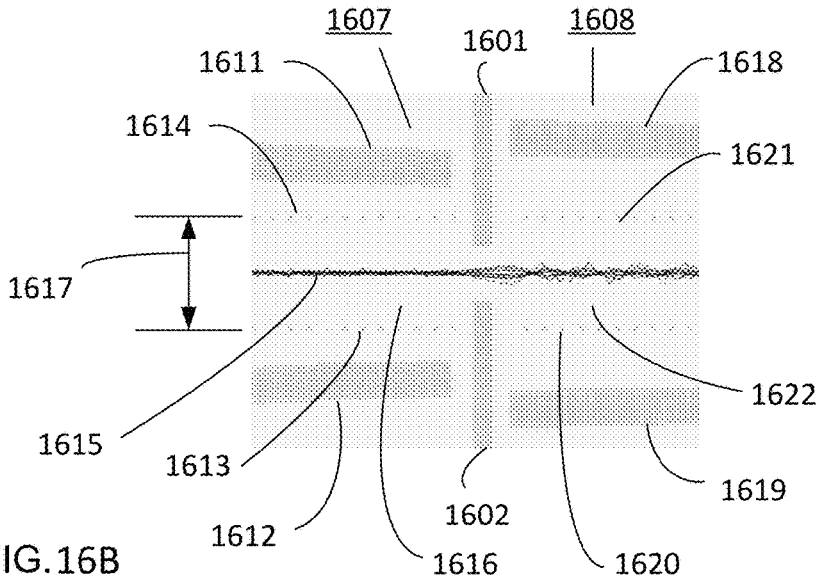
FIG. 16B
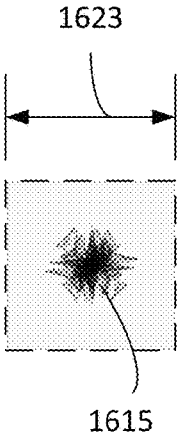
FIG. 16C
FIG. 16D
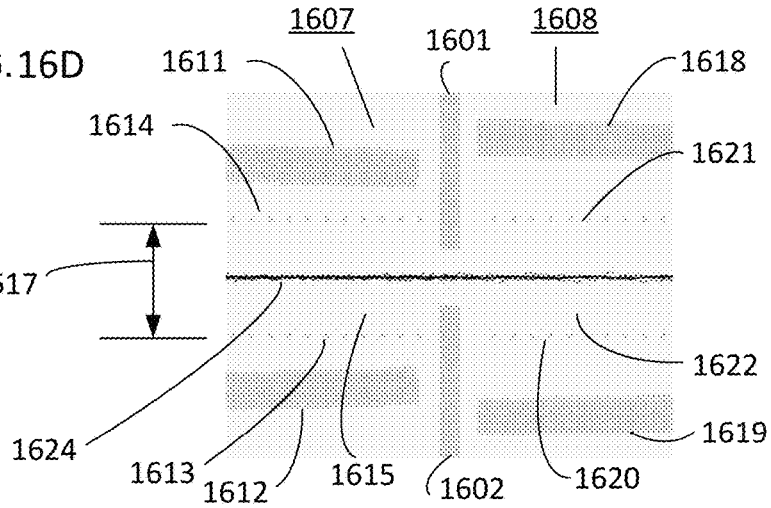
FIG. 16E
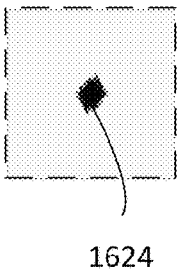

RF ION GUIDE WITH AXIAL FIELDS

CROSS REFERENCE TO RELATED APPLICATIONS

This application is a continuation of U.S. patent application Ser. No. 15/445,891, filed Feb. 28, 2017, which is a continuation of U.S. patent application Ser. No. 14/734,916, filed Jun. 9, 2015, which claims the benefit of U.S. provisional application 62/011,953, filed Jun. 13, 2014, the entire content of which is hereby incorporated by reference.

TECHNICAL FIELD

This disclosure relates to radio-frequency (RF) ion guides and two-dimensional RF ion traps for transmitting, manipulating and processing ions in various background gas pressures.

BACKGROUND

Mass spectrometers often include at least one RF ion guide which is operated in a region of relatively high pressure where collisions occur between ions and background gas molecules. The ion kinetic energies may be arranged in some configurations so that such collisions are energetic enough to cause collision induced dissociation (CID) of ions. In other configurations, the collision energies may be relatively low so that such collisions primarily cause a reduction of ion kinetic energies, which is sometimes referred to 'collision cooling'. Collision cooling is often used in addition to CID in the same ion guide.

One consequence of such collision cooling is that collision cooling can result in so much reduction of ions' kinetic energy that their motion through the ion guide becomes very slow or even stagnant. To alleviate this problem, RF ion guide configurations have been developed that incorporate a potential gradient along the ion guide axis, which provides a motive force to ensure that ions cooled by collisions continue their motion along the ion guide axis to the ion guide exit. In other configurations, ions can be directed to an RF ion guide exit end by such an axial field, but a local potential barrier at the exit end may be imposed in order to prevent the ions from exiting the ion guide until the potential barrier is lowered. Ions are then trapped and accumulated near the ion guide exit, and can be retained there while additional collision cooling occurs. At the opportune time, the trapped ions can be abruptly accelerated out the ion guide exit by switching voltages applied to the exit electrode and/or the ion guide electrodes so as to convert the potential barrier field to an acceleration field. Such trapping and collision cooling is advantageous, for example, to alleviate duty cycle limitations of orthogonal time-of-flight (TOF) analyzers, by retaining ions in the trap between TOF pulses. Trapping ions in this manner also allows them to be subjected to other manipulations, such as fragmentation by resonant excitation, or ion-ion interactions such as electron transfer dissociation (ETD).

Collision cooling with or without trapping also causes the width of the kinetic energy distribution of a population of ions within an ion guide to be reduced, that is, causes the kinetic energies of the ions to become more similar. Consequently, for example, some or all ions can be subsequently directed with the same nominal kinetic energy into an orthogonal acceleration TOF analyzer, or other mass spectrometer, thereby overcoming mass discrimination that would otherwise result from the disparate ion kinetic energies. Relatively broad ion kinetic energy distributions are exhibited, for example, in a broad mass-to-charge (m/z) distribution of fragment ions produced in a collision cell operated at relatively low gas pressures, where significant collision cooling does not occur. In this case, fragment ions tend to travel at about the same velocity as the precursor ion, so the ion kinetic energy distribution in the resulting population of fragment ions reflects the potentially broad m/z distribution in the ion population. Another example where the initial ion population exhibits a relatively broad ion kinetic energy distribution is the case where ions are introduced into a vacuum region from a higher-pressure region via a supersonic expansion of gas passing through the orifice between the two regions. In such a situation, ions of different m/z values end up with similar velocities, and therefore exhibit a wide ion kinetic distribution reflective of their wide m/z distribution. In all such situations, the incorporation of collision cooling in a high pressure ion guide region acts to narrow a broad ion kinetic energy distribution, and the addition of an axial field in such a high pressure region helps to maintain continuous motion of cooled ions toward the ion guide exit.

Alternatively, axial fields have been utilized in RF ion guides where the axial field is oriented to impede the motion of ions, essentially providing a repelling electric field that is adjusted to reject ions from an ion population that have less than some specified kinetic energy. This approach is used with advantage in some inductively coupled plasma mass spectrometry (ICP/MS) instruments to reduce or eliminate mass spectral interferences.

In still other configurations, RF ion guides having an axial field have been used in a high pressure vacuum stage of an atmospheric pressure ion source interface to a mass spectrometer, in order to improve ion transmission efficiency through to the subsequent lower pressure vacuum stage, while allowing the background gas to be pumped out.

A rectilinear quadrupole, having wide flat electrodes with widths of, for example, 82% of the separation between opposing electrodes, provides better ion transport properties than RF ion guides having round rods, especially when a collision gas is present. However, such an ion guide provides very little access via the spaces between the RF electrodes, which almost meet at the corners of the square electrode arrangement. Therefore, generating a significant axial field within such rectilinear ion guides is difficult.

SUMMARY

The methods and apparatus disclosed herein to produce an axial potential gradient in an RF ion guide allow axial fields to be readily generated within rectilinear ion guides, as well as ion guides other than rectilinear, such as round rod ion guides.

RF ion guides are disclosed that have elongated rod electrodes with RF voltages applied, and which are arranged longitudinally about a common ion guide axis, to form a quadrupole, hexapole, octopole, or greater, RF ion guides. The RF voltages have the same RF voltage amplitude applied to each such RF electrode, but with opposite phases on neighboring electrodes, and the RF voltages can all have the same DC offset reference voltage, which defines the nominal potential of the ion guide axis, absent other voltages. One or more auxiliary electrodes having DC voltages applied are also provided, which are also arranged longitudinally about the common ion guide axis. These auxiliary electrodes are provided with a DC voltage that is different from DC offset reference voltage of the RF electrodes, thereby establishing a DC auxiliary field between the RF electrodes and the auxiliary electrodes. At least two of the RF electrodes include openings in the respective RF electrode between the electrode surface facing the ion guide axis and the electrode surface that faces away from the ion guide axis and toward the auxiliary electrodes. These openings allow the auxiliary DC fields to influence the DC potentials within the ion guide, that is, to establish a DC offset potential within the ion guide that is different from the DC offset potential that would result solely from the DC offset reference voltage applied to the RF electrodes. Surprisingly, such openings in the RF electrodes were found to have little impact on ion guiding and/or trapping functionality provided by the applied RF and DC voltages and associated RF and DC fields along the ion guide axis. Generally, the arrangements of RF electrodes and auxiliary electrodes and associated voltages are such that the dominant influence of the auxiliary DC field on the ion guide axis potential is due to this field penetration through the RF electrodes openings, rather than any field penetration in gaps between the RF electrodes. Therefore, the disclosed methods and apparatus are especially advantageous for modifying the potential distribution on the axis of rectilinear RF ion guide and two-dimensional ion traps, in which the gaps between neighboring RF electrodes where the edges of the flat plate RF electrodes meet are typically too small to allow significant field penetration from conventional auxiliary electrodes. Other embodiments utilizing round or hyperbolic rod surfaces can also provide auxiliary fields that penetrate through the RF electrodes to generate an axial electric field along the ion guide axis. Hyperbolic-shaped electrodes have gaps between neighboring hyperbolic electrodes that decrease with increasing distance from the axis, so that the effectiveness of DC fields from auxiliary electrodes located between the RF electrodes thus decreases accordingly. Methods and apparatus disclosed herein are particularly beneficial for such hyperbolic-shaped electrodes.

Some embodiments can also provide for operation as a quadrupole mass filter, with or without the presence of background collision gas, where RF voltage alone is applied to the RF rods, while the resolving DC voltages are applied separately to the auxiliary DC electrodes. In this case, a positive DC voltage can be applied to one opposing pair of auxiliary DC electrodes, while a negative DC voltage can be applied to the other opposing pair of electrodes. The advantage of this arrangement is that the RF voltages and DC voltages do not have to be combined and applied to the same electrodes, thereby simplifying the associated RF and DC electronics, and resulting in a more stable and flexible electrical arrangement. This operation is not possible with conventional RF ion guides having axial fields generated by auxiliary DC electrodes positioned between the RF rods as the DC component of the resulting electric field in the ion guide is not directed along planes that include the RF rods, for mass filter operation.

By judiciously configuring the geometry of the openings in the RF electrodes, the geometrical arrangement of the RF electrodes, and the geometrical arrangement of the auxiliary electrodes in various ways, the relative contribution of the auxiliary DC field to the ion guide axial potential can be made to vary along the ion guide axis, thereby providing an axial electric field within at least a portion of the ion guide length. Various embodiments include varying the configuration of these electrode geometries and their applied voltages, respectively.

The openings in the RF electrodes can be provided by various means, including: a conductive grid or mesh or array of wires arranged longitudinally and/or transversely to the ion guide axis, along at least a portion of the RF electrode length, which forms at least a portion of the RF electrode surface exposed to the ion guide axis; longitudinal and/or transverse slots machined into RF electrodes; or generally the openings can be provided as a one or two dimensional array of holes having various shapes along RF electrode surfaces.

The RF electrode surfaces exposed to the ion guide axis can be planar, round, hyperbolic, or any other surface shape.

The auxiliary electrodes can also have planar surfaces, round surfaces, hyperbolic surfaces, or any other surface shape.

Fundamentally, an axial potential gradient, that is, an axial field, can be produced by one or more of the following approaches: 1) varying the strength of the auxiliary DC field along at least a portion of the ion guide length; 2) varying the transparency of the RF electrodes to the DC auxiliary fields along at least a portion of the ion guide length by varying the size of the openings along at least a portion of the length of the RF electrodes; and/or 3) tilting both the auxiliary electrodes and the RF electrodes by the same angle relative to the ion guide axis, leading to smaller overall dimensions of the ion guide as the electrodes come closer to the axis, and resulting in a greater contribution of the auxiliary DC field to the axial potential while keeping the auxiliary DC field and the size of the openings in the RF electrodes constant along the length of the RF electrodes.

In the first of these approaches, the strength of the auxiliary DC field can vary along the ion guide axis when the distance between the auxiliary electrode and the RF electrode varies along the ion guide length. For example, the RF electrodes can be arranged parallel to the ion guide axis while the auxiliary electrodes are arranged at a tilt angle with respect to the axis, resulting in a varying separation between the auxiliary electrodes and both the RF electrodes and the ion guide axis along at least a portion of the ion guide length. Alternatively, the RF electrodes may vary their distance from the ion guide axis by tilting them at an angle with respect to the axis, while the auxiliary electrodes remain parallel to the axis, or tilted with respect to the ion guide axis by a tilt angle that is different from that of the RF electrodes. In such embodiments, both the axial potential and the RF fields within the ion guide will vary along the ion guide axis.

The strength of the auxiliary DC field can also be made to vary along the ion guide axis, with or without varying the separation distance between the auxiliary and RF electrodes, when the auxiliary electrodes are segmented and have different auxiliary DC voltages applied to different segments. Alternatively, the auxiliary electrodes can be configured with a continuous electrically resistive material and a voltage difference is applied along its length.

In the second of the above-mentioned approaches, an axial field can also form when the degree of penetration through the RF electrodes of the auxiliary DC field varies along the ion guide axis by virtue of the relative 'transparency' of the RF electrode openings to the auxiliary DC field. In some embodiments, the RF electrode surfaces include conductive wires spaced apart with open gaps between them, where the density of the wires varies, by varying the spacing between them, that is, the size of the gaps varies, along at least a portion of the ion guide length. Alternatively, RF electrodes can be configured each with one or more longitudinal slots along at least a portion of the ion guide axis, and the auxiliary DC field penetration through the RF electrode longitudinal slot varies along the ion guide length portion by arranging the width of the slot(s) to vary along the portion. In some embodiments, the openings in the RF electrodes can be made by slots of equal width configured transverse across the RF electrodes, and the transparency of the RF electrodes to the auxiliary DC fields vary along the ion guide length if the spacing between slots varies along the ion guide length.

In some embodiments, an axial potential gradient can be obtained by tilting both the auxiliary electrodes and the RF electrodes by the same angle relative to the ion guide axis along at least a portion of the ion guide length, so that the spacing between the auxiliary and RF electrodes remains constant along this portion. Since the spacing between the auxiliary electrodes and the RF electrodes remains constant, the auxiliary DC field remains relatively constant. While the 'transparency' of the RF electrodes can remain nominally constant as well along the length of the ion guide, nevertheless, because all electrodes are tilted with respect to the axis, the cross sectional dimensions of the ion guide become smaller as the electrodes come closer to the axis, which means that the openings in the RF electrodes represent an increasing portion of the ion guide cross section. Consequently, the auxiliary DC field has an increasing influence on the axis potential as the electrodes come closer to the axis by virtue of the tilted configuration. In such embodiments where the RF electrodes are tilted with respect to the ion guide axis, the strength of the RF fields within the ion guide will vary along the ion guide axis as the RF electrodes get closer to the axis. This can be advantageous for producing a more tightly focused ion beam due to the deeper potential well resulting from the increased RF fields with decreasing internal aperture size of the ion guide.

RF ion guides having an axial field as disclosed herein can be utilized in various ways. RF ion guides having an axial field are used advantageously for rapid transport of ions through relatively high pressure environments, including, but not limited to: high-pressure collision-induced dissociation (CID) cells with collision cooling; a high pressure vacuum stage of an atmospheric pressure ion source interface or other high pressure stage; the vacuum partition ion guide between a high pressure vacuum stage and a subsequent lower pressure vacuum stage; and a collision cell used for collision cooling without CID.

RF ion guides disclosed herein can also be combined with one or more entrance and exit RF or DC aperture electrodes, which can be supplied with fast switching voltages to facilitate trapping of ions within the ion guide using one set of voltages to establish a local trapping voltage proximal to the ion guide exit, and alternately switching the voltages to allow trapped ions to exit the ion guide toward downstream components, such as the pulsing region of an orthogonal time-of-flight mass analyzer. Also, the RF ion guide may be segmented into at least two segments, where each segment may have different RF voltages and/or frequencies and/or DC voltages applied. For example, a short RF ion guide segment may be configured at the ion guide exit, separated from the upstream segment by an RF or DC aperture electrode, to provide a trapping region for ions, from which trapped ions are pulse-ejected axially towards downstream components, such as an orthogonal time-of-flight pulsing region. Alternatively, or concomitantly, similar fast switching voltages can be applied to the RF ion guide electrodes and/or the auxiliary electrodes to effect similar results.

In some embodiments, the axial potential distribution is manipulated to effect local ion trapping in local potential wells, moving these potential wells along the axis, and/or trapping different ion populations (positive and/or negative ions) simultaneously in the same ion guide but within separate local potential wells, then allowing them to coalesce and effect ion-ion interactions, such as Electron Transfer Dissociation (ETD).

Additionally, curved axial field ion guides can also be used. Curved axial field ion guides are ion guides in which the ion guide axis is curved, as in the shape of a circle, for example.

In general, in one aspect, the disclosure features apparatus that includes an ion source, a mass analyzer, and an RF ion guide positioned in an ion path between the ion source and the mass analyzer. The RF ion guide having an ion guide axis extending between an input end of the RF ion guide and an exit end of the RF ion guide. The RF ion guide includes a first electrode extending along the RF ion guide axis, the first electrode configured to be connected to a voltage source; and a second electrode extending along the RF ion guide axis, the second electrode configured to be connected to a RF source, the second electrode being positioned between the first electrode and the ion guide axis, the second electrode comprising one or more apertures. The first and second electrodes are configured so that during operation of the RF ion guide an electric field at the ion guide axis has a non-zero axial component. The first electrode may also be connected to the RF source so as to minimize RF fields between the first and second electrodes, such as with coupling capacitors so that the auxiliary DC voltage can be maintained on the auxiliary electrodes as a DC offset voltage to the applied RF voltage.

Embodiments of the system may include one or more of the following features and/or features of other aspects. For example, the first electrode can be configured to generate an electric field that impinges on the ion guide axis, the electric field configured to pass through the one or more apertures of the second electrode in a direction approximately perpendicular to the ion guide axis.

The first electrode can be configured to produce a first electric potential at the input end of the ion guide axis and a second electric potential at the exit end of the ion guide axis, the first electric potential being different from the second electric potential.

The second electrode includes a planar conductor extending along the ion guide axis, a central portion of the planar conductor includes a grid. The grid can have a grid density that varies along a direction of the ion guide axis.

The RF ion guide can include three additional electrodes extending along the ion guide axis, each of the additional electrode includes a planar conductor, where each planar conductor is located on the opposite side of the ion guide axis from and parallel to the planar conductor of another of the electrodes.

The RF ion guide can include further electrodes including the first electrode, each of the further electrodes extending along the ion guide axis, each of the planar conductors being positioned between the ion guide axis and a corresponding one of the further electrodes. The first electrode can extend along the ion guide axis and is non-parallel to the ion guide axis.

The second electrode can be tilted with respect to the ion guide axis, and the first electrode can be titled at a different angle from the second electrode. The first electrode can extend parallel to the planar conductor of the second electrode.

The RF ion guide can include three additional electrodes extending along the ion guide axis, each of the additional electrode includes a planar conductor, where each planar conductor is located on an opposite side of the ion guide axis from and parallel to the planar conductor of another of the electrodes, and the first electrode comprises a cylindrical conductor symmetrically enclosing the planar conductors.

The second electrode can include a planar conductor, a central portion of the planar electrode includes an elongated slot extending along a direction of the ion guide axis. The slot can have a width that varies along the direction of the ion guide axis. The second electrode can include a hollow cylindrical conductor extending along the ion guide axis having a plurality of slots having different slot width, and the first electrode can include a rod positioned inside the hollow cylindrical conductor. The second electrode can have a first cross-sectional area at the input end that is different from a second cross-sectional area at the exit end. The second electrode can be configured to provide collision cooling to ions entering through the input end of the RF ion guide. The first electrode can include a plurality of conductors, each conductor being connected to a different voltage source to provide an electric field profile along the ion guide axis. The RF ion guide can be configured to cause collision induced dissociation of ions entering through the input end of the RF ion guide.

In general, in another aspect, the disclosure features methods that include ionizing a sample to generate ions, introducing the ions through an input end of a RF ion guide to collide with background gas in the RF ion guide, providing an axial electric field along an ion guide axis of the RF ion guide to cause ions that have undergone collisions to exit the RF ion guide; and mass analyzing the ions that have undergone collisions and exited the RF ion guide. Providing the axial electric field can include applying a DC voltage to a first electrode of the RF ion guide that surrounds a second electrode of the RF ion guide such that an electric field produced by the first electrode penetrates the second electrode before impinging on the ion guide axis.

In some embodiments, methods further include varying the DC voltage applied to the first electrode to provide a time-dependent moving local potential well within the RF ion guide to control motions of ions along the ion guide axis. Methods further include varying the DC voltage applied to the first electrode to locally trap positive and negative ions in separate potential wells and merging the positive and negative ions to effect ion-ion reaction. Ions that have undergone collisions can have a reduced radial distribution compared to ions that have not undergone collisions. Methods further include fragmenting the ions introduced through the input end by collision induced dissociation.

In general, in another aspect, the disclosure features RF ion guides having an ion guide axis extending between an input end of the RF ion guide and an exit end of the RF ion guide. The RF ion guide includes a voltage source, a RF source, a first electrode extending along the RF ion guide axis, the first electrode configured to be connected to the voltage source and a second electrode extending along the RF ion guide axis. The second electrode can be configured to be connected to the RF source, the second electrode can be positioned between the first electrode and the ion guide axis, the second electrode includes one or more apertures. The first and second electrodes can be configured so that during operation of the RF ion guide an electric field at the ion guide axis has a non-zero axial component.

In some embodiments, the first electrode can be configured to generate an electric field that impinges on the ion guide axis, the electric field configured to pass through the one or more apertures of the second electrode in a direction approximately perpendicular to the ion guide axis. The first electrode can be configured to produce a first electric potential at the first end of the ion guide axis and a second electric potential at the second end of the ion guide axis, the first electric potential being different from the second electric potential.

The details of one or more embodiments are set forth in the accompanying drawings and the description below. Other features and advantages of the disclosure will be apparent from the description and drawings, and from the claims.

BRIEF DESCRIPTIONS OF DRAWINGS

FIG. 15A shows ion trajectory calculation using the assembly of FIG. 4.

FIG. 15B shows ion trajectory calculation using the assembly of FIG. 4 after a first time period.

FIG. 15C shows a calculated axial potential distribution of the assembly of FIGS. 15A and 15B with a potential barrier imposed at the ion guide exit region.

FIG. 16A shows an end view of one embodiment of an RF aperture.

FIG. 16B shows ion trajectories in a cross-section of the exit region of one rectilinear ion guide having an axial field, the RF aperture of FIG. 16A with a DC offset voltage but no RF voltages applied, and the entrance region of a second rectilinear ion guide having an axial field.

FIG. 16C shows a magnified axial view of ion trajectories along a portion of the second ion guide of FIG. 16B.

FIG. 16D is the same as FIG. 16B except that an RF voltage is now applied to the RF aperture.

FIG. 16E is the same as FIG. 16C except that the RF voltage of FIG. 16D is now applied to the RF aperture.

DETAILED DESCRIPTION OF THE INVENTION

Figure 1:
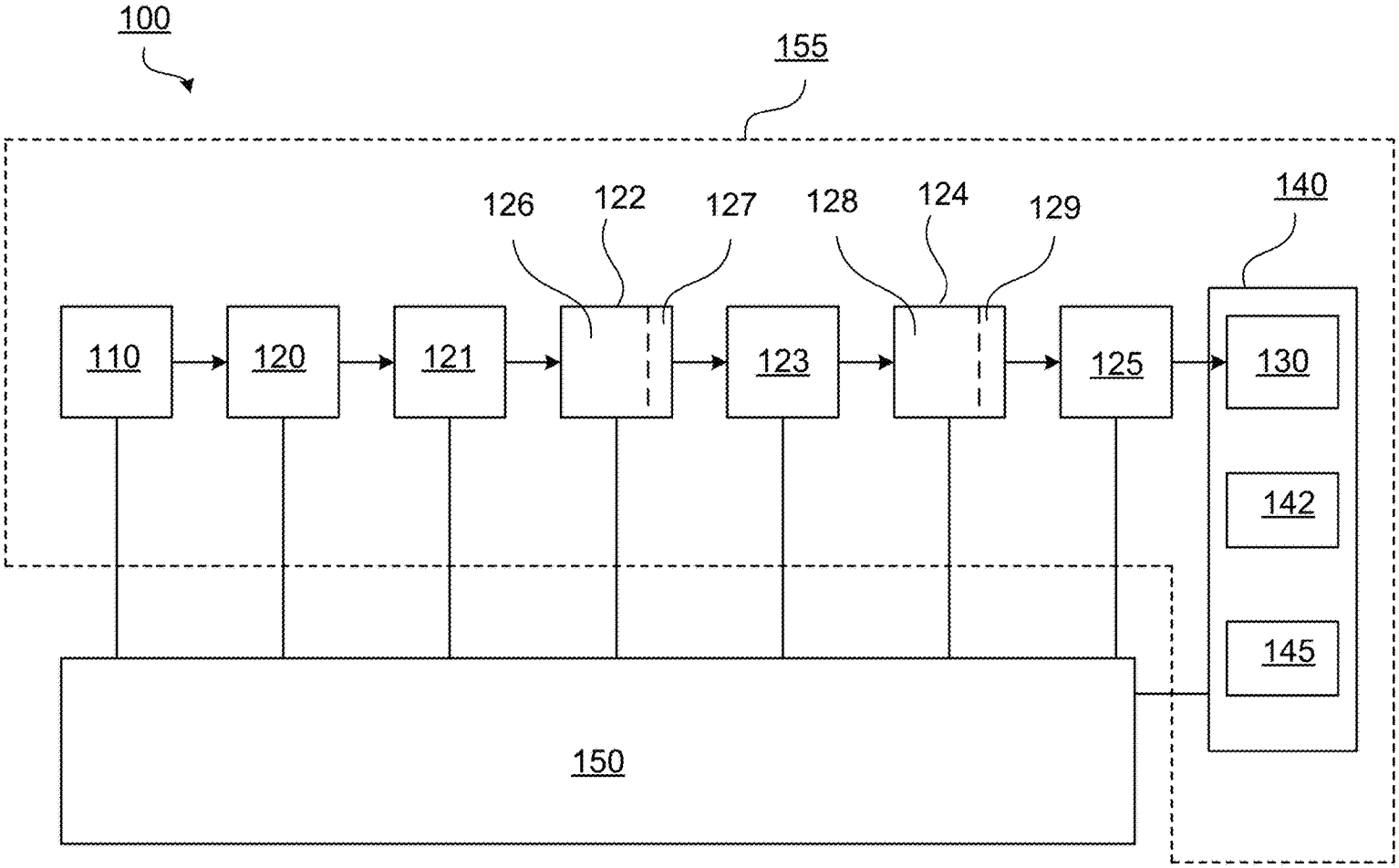
FIG. 1 shows a schematic diagram of an orthogonal acceleration time-of-flight (OA-TOF) mass spectrometer system.

FIG. 1 schematically depicts an orthogonal acceleration time-of-flight (OA-TOF) mass spectrometer system 100 that includes an ion source 110, which creates ions from a sample under analysis; an ion transport assembly 120 (which may include, e.g., one or more RF multipole ion guides, and/or electrostatic focusing lenses and/or apertures, and/or deflectors and/or capillaries, and/or skimmers); a mass analyzer 121 (such as a quadrupole mass filter or magnetic sector analyzer or 2D or 3D ion trap mass analyzer); an RF multipole ion guide assembly 122; a collision cell assembly 123; an RF multipole ion guide assembly 124; an ion transport assembly 125 (which may include, e.g., one or more RF multipole ion guides, and/or electrostatic focusing lenses and/or apertures, and/or deflectors and/or capillaries, and/or skimmers); an OA-TOF analyzer assembly 140, and an electronic controller 150.

Ion transport assembly 120; mass analyzer 121; RF multipole ion guide assembly 122; collision cell assembly 123; RF multipole ion guide assembly 124; ion transport assembly 125; and OA-TOF analyzer assembly 140, are housed in one or more vacuum chambers 155. In general, a variety of ion sources can be used for ion source 110. Ion sources can be broadly classified into sources that operate within a vacuum or partial vacuum (that is, at pressures substantially less than atmospheric pressure), as shown schematically in FIG. 1, and ion sources that provide ions at, or near, atmospheric pressure, so-called atmospheric pressure ion (API) sources. Examples of non-atmospheric ion sources of the former type can be chemical ionization (CI), electron ionization (EI), fast atom bombardment (FAB), flow FAB, laser desorption (LD), MALDI, and particle beam (PB) ion sources. Examples of API sources include electrospray (ES) and atmospheric pressure chemical ionization sources (APCI), inductively coupled plasma (ICP), glow discharge (GD), thermospray (TS), and atmospheric pressure matrix assisted laser desorption ionization (MALDI) sources. Such API sources are housed outside vacuum chambers 155 (not shown in FIG. 1). Ion transport assembly 120 would then include components that provide an interface between the pressure of the API source and the downstream vacuum chamber, such as a gas-flow-limiting orifice or capillary.

Time-of-flight analyzer assembly 140 includes an orthogonal pulse-acceleration assembly 130, a field-free flight tube 142, optionally a reflectron mirror (not shown), and a detector 145.

During operation of system 100, ion source 110 generates ions that are transported by ion transport assembly 120 into mass analyzer 121. In some embodiments, ion transport assembly 120 includes an RF multipole ion guide, a portion of which operates within a vacuum region at background gas pressures high enough for collisions between ions and background gas molecules to occur. RF multipole ion guide of assembly 120 may include a means for creating an axial field along at least a portion of the axis of the RF multipole ion guide to increase the transport speed of the ions. Ion transport assembly 120 may be configured to extend continuously between two or more vacuum stages of vacuum system 155.

Mass analyzer 121 selects ions having one of more mass-to-charge (m/z) values. In preferred embodiments, the m/z selected ions are transferred into RF multipole ion guide assembly 122. In other preferred embodiments, RF multipole ion guide assembly 122 is omitted and the m/z selected ions are transferred directly into collision cell assembly 123. Multipole ion guide assembly 122 includes means for creating an axial field along at least a portion of its axis, and means for maintaining a local gas pressure along its length that is high enough that collisions occur between ions and the background gas molecules to enable ion collision cooling. Examples of such means include an enclosure surrounding the ion guide of assembly 122 for retaining gas admitted via a gas source and a valve. In some embodiments, at least part of the enclosure can form the auxiliary electrodes that generate the axial field, while in other embodiments, a completely separate enclosure may be employed that encloses both the RF ion guide electrodes as well as the auxiliary electrodes. The ion guide assembly 122 is also referred to as a "Precursor Ion Trap". The exit electrode in the ion guide assembly 122 is also referred to as the "Precursor Ion Trap Exit Gate". Multipole ion guide assembly 122 also includes means for operating ion guide 122 in a mode to trap ions within a region 127 proximal to the exit end of ion guide assembly 122, or in a mode to release/transmit ions. Examples of such means includes DC power supplies switchable between a voltage level that acts to trap ions within the ion guide by generating a potential barrier, or a level that allows ions to pass out the exit of the ion guide. In trap mode, a combination of an axial potential gradient that drives ions toward the ion guide exit, and a repelling potential applied to an exit electrode or other downstream component proximal to the ion guide exit, such as a subsequent ion guide within assembly 122 region 127 causes ions to be trapped in a local potential well within the region 127 proximal to the ion guide exit. In trap mode, ions accumulate in this potential well as they cool within the ion guide, thereby focusing them proximal to the exit. For example, ions that have undergone collisions can have a reduced radial distribution compared to ions that have not undergone collisions. Ions can then be released/transmitted downstream by switching the voltage applied to the exit component to create an accelerating field. The means for trapping ions within ion guide assembly 122 can also include an entrance electrode to which a voltage can be applied that is repelling to ions within the ion guide. The application of such a repelling voltage to the entrance electrode prevents ions within the ion guide from exiting the ion guide in the reverse direction through the entrance end, in case collision cooling within the ion guide had not yet removed enough of the ions' kinetic energy to remain trapped within the ion guide.

In some embodiments, the region 127 includes a short section of RF-only ion guide having an entrance aperture electrode and an exit aperture electrode, to which DC voltages and/or pulsed DC voltages can be applied. The entrance aperture electrode and the exit aperture electrode may be configured as RF apertures in this region 127, and similarly in region 129 described below with respect to FIGS. 16A-16E, where the aperture is formed by a set of four planar electrodes arranged symmetrically about the axis in an array similar to the neighboring RF ion guide electrodes, and have RF voltages similarly applied, as described in co-pending application Ser. No. 14/292,920, the disclosures of which are fully incorporated herein by reference. Ions can be transferred into the region 127 from the upstream section 126 of ion guide assembly 122, where the ions had been cooled and/or trapped, and trapped within region 127 for some time period. Ions can then be pulse-accelerated from the exit of region 127 by the abrupt application of pulsed DC voltages applied to the entrance and/or exit aperture electrode and/or DC auxiliary electrodes and/or RF offset voltage of region 127. Such a short section of RF-only ion guide enables a very fast pulse-ejection of the ion population cooled and trapped near the exit end of the ion guide assembly 122 when the cooled trapped ions are first released gently through the exit aperture of the segment 126 into the short ion guide segment 127. Once the ion population is further trapped and cooled within the short section 127, the ions can be pulse out very quickly by imposing a pulse voltage difference between an entrance aperture (exit aperture electrode of section 126) and the exit aperture of the short section 127, and/or DC auxiliary electrodes and/or RF offset voltage. A similar short ion guide trapping section 129 can also follow an ion guide cooling section 128 of ion guide assembly 124. Electronic controller 150 includes means for switching between the trapping operation mode and the ion release/transmit operation mode, as well as controlling the timing and duration of each operating mode, of RF multipole ion guide assembly 122. Example of such means include DC voltage supplies connected to the aperture electrodes and/or the ion guide sections of assembly 122 via high speed switches, which are controlled by a programmable timing controller.

Ions transmitted by ion guide assembly 122 enter collision cell assembly 123. Collision cell assembly 123 includes an RF multipole ion guide for guiding ions from the entrance end of the assembly 123 to the exit end, and means for maintaining background gas pressure along at least a portion of the collision cell axis so that collisions occur between ions and background gas molecules. Examples of such means include an enclosure surrounding the ion guide of assembly 123 for retaining gas admitted via a gas source and a valve.

In some embodiments, the background gas pressure, length of the collision cell, and the kinetic energy with which ions pass through the collision cell, are controlled such that collision-induced dissociation (CID) due to collisions between ions and background gas molecules occurs, but do not introduce substantial collision cooling. As such, most (e.g., all) un-fragmented precursor ions and fragment ions of a possibly wide range of m/z values reaching the collision cell exit travel with essentially the same (or similar) axial velocities, resulting in ion kinetic energies that are roughly proportional to their m/z values, respectively. However, for an orthogonal TOF mass analyzer to analyze and record the intensities of a wide range of m/z values, ions ideally have essentially the same kinetic energy. Hence, the ion population exiting the collision cell assembly 123 are directed into RF multipole ion guide assembly 124, which, similar to RF multipole ion guide assembly 122, includes means for creating an axial field along at least a portion of its axis, and means for maintaining a local gas pressure along its length that is high enough that collisions occur between ions and the background gas molecules to enable ion collision cooling. Examples of such means include an enclosure surrounding the ion guide of assembly 124 for retaining gas admitted via a gas source and a valve.

In some embodiments, at least part of the enclosure can form the auxiliary electrodes that generate the axial field, while in other embodiments, a completely separate enclosure may be employed that encloses both the RF ion guide electrodes as well as the auxiliary electrodes. Ion guide assembly 124 is referred to as the "Cooling Trap" in FIG. 2.

Multipole ion guide assembly 124 also includes means for operating ion guide 124 in a mode to trap ions, or in a mode to release/transmit ions. Examples of such means include DC power supplies switchable between a voltage level that acts to trap ions within the ion guide due to the resulting potential barrier, or a level that allows ions to pass out the exit of the ion guide. In some embodiments, ions are trapped within assembly 124 by applying a voltage to an exit electrode, or other downstream component, proximal to the ion guide exit, that acts as a potential barrier for ions trying the exit the ion guide. Similarly, a voltage is also applied to an entrance electrode, or other upstream component proximal to the ion guide entrance, which provides a potential barrier to ions trying to exit the ion guide back through the ion guide entrance. The trapping entrance potential barrier may be adjusted to trap at least a portion of the ion population within the ion guide of assembly 124.

Further, a potential barrier at the ion guide entrance may be applied continuously, or only after ions have entered the ion guide during some time period. Trapped ions experience collisional cooling and, in some embodiments, can accumulate in a local potential well within a region 129 proximal to the ion guide exit that is created by the combination of an axial potential gradient that drives ions toward the ion guide exit, and a repelling potential applied to an exit electrode, or other downstream component proximal to the ion guide exit, such as a subsequent ion guide within assembly 124. Ions can then be released/transmitted downstream by switching the voltage applied to the exit component to create an accelerating field.

In some embodiments, the ion trapping region 129 includes a short section of RF-only ion guide with an entrance aperture electrode and an exit aperture electrode, to which DC voltages and/or pulsed DC voltages can be applied. Ions can be transferred into the region 129 from the upstream cooling/trapping section 128 of ion guide assembly 124, where the ions had been cooled and/or trapped, and be trapped within the region 129 for some time period. Ions can then be pulse-accelerated from the exit region 129 by an abrupt application of pulsed DC voltages to the entrance and/or exit aperture electrodes and/or DC auxiliary electrodes and/or RF offset voltage of the region 129.

Such a short section of RF-only ion guide enables a very fast pulse-ejection of the ion population cooled and trapped near the exit end of the ion guide assembly 124 when the cooled trapped ions are first released gently through the exit aperture of the segment 128 into the short ion guide segment 129. Once the ion population is further trapped and cooled within the short section 129, the ions can be pulse out very quickly by imposing a pulse voltage to an entrance aperture (exit aperture electrode of section 128), and/or the exit aperture of the short section 129 and/or DC auxiliary electrodes and/or RF offset voltage.

Electronic controller 150 includes means for switching the voltages applied to the entrance and exit electrodes, or other components proximal to the entrance and/or exit ion guide ends, independently. The ion guide can switch between the trapping operation mode and the ion release/transmit operation mode at each end of the ion guide independently. The timing and duration of each transition can also be controlled. Example of such means include DC voltage supplies connected to the aperture electrodes and/or the ion guide sections of assembly 124 via high speed switches, which are controlled by a programmable timing controller.

Ions exiting ion guide assembly 124 are transmitted by ion transport assembly 125 as an ion beam into the orthogonal pulsing region 130 of orthogonal acceleration TOF analyzer assembly 140. Ions from a segment of the ion beam are pulse-accelerated periodically into TOF field-free flight tube 142 for time-of-flight m/z analysis of the ion population. The relative timing between the pulse-ejection of ions from the trapping region 129 of ion guide assembly 124, and the orthogonal pulse-acceleration of a segment of the ion beam in TOF 140 pulsing region 130, may be adjusted to optimize TOF analysis sensitivity of a selected range of ion m/z values. As ions are pulse-accelerated to the same nominal kinetic energy and travel essentially the same nominal distance to the detector, their flight times to the detector are proportional to the square root of their m/z values. Ions of a particular m/z value impinging on detector 145 at any point in time generate a detector signal proportional to their abundance. Signals from the detector are recorded with a data acquisition system, included generally within electronic controller 150.

Controller 150 is also in communication with ion transport assembly 120; mass analyzer 121; RF multipole ion guide assembly 122; collision cell assembly 123; RF multipole ion guide assembly 124; ion transport assembly 125; and OA-TOF analyzer assembly 140, coordinating data acquisition and analysis with the operation of the various components of system 100. Controller 150 can include power supplies and electrical connections for applying voltages (e.g., AC and/or DC) to ion transport assembly 120; mass analyzer 121; RF multipole ion guide assembly 122; collision cell assembly 123; RF multipole ion guide assembly 124; ion transport assembly 125; and OA-TOF analyzer assembly 140, including RF, continuous DC and pulse-DC voltages applied to various electrodes, as described in more detail below, in addition to electronic processors such as timers, data analyzers, input (e.g., keyboards or keypads) and output devices (e.g., one or more displays) that facilitate operation of the system.

Figure 2:
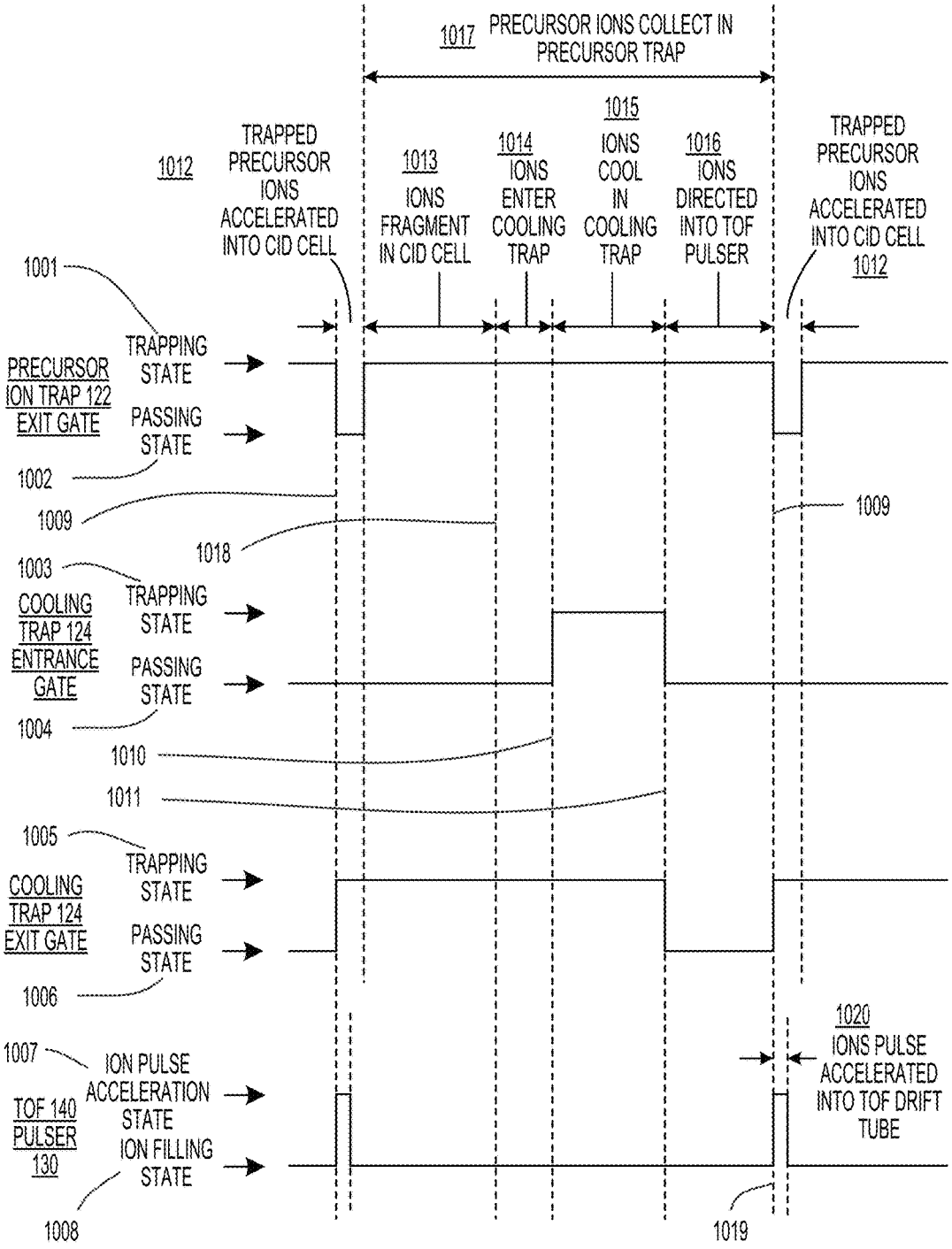
FIG. 2 shows an exemplary timing diagram used to operate the system shown in FIG. 1.

FIG. 2 shows an exemplary timing diagram used for operating the system 100 shown in FIG. 1. Ions produced in the ion source 110 are transported via ion transport assembly 120 into mass analyzer 121. Mass analyzer 121 selects so-called 'precursor' ions of a particular m/z value, or a small range of m/z values (for example, which includes two or more isotopes of a particular ion), which then pass continuously into RF ion guide assembly 122 through its entrance end (i.e., potential trapping barrier is not introduced at the entrance end). In FIG. 2, the trapping and transmitting states of the exit electrodes are labeled the "Trapping State" and the "Passing State", respectively. During the Trapping State 1001, selected precursor ions are trapped, collision cooled, and accumulated in the local potential well in section 127 proximal to the exit end of RF ion guide assembly 122. At time 1009, the trapped ions are released and the Precursor Ion Trap Exit Gate is switched from the trapping state to the passing state. Precursor ions that had accumulated in the local potential well in section 127 proximal to the exit electrode abruptly experience a new electric field that accelerates them out the exit of the ion guide as a short ion packet, into the collision cell assembly 123 during time period 1012. Time period 1012 may be a few microseconds to a few hundred microseconds, (e.g., about 50 microseconds), after which the Precursor Ion Trap Exit Gate returns to Trapping State 1001 to continue trapping precursor ions.

The precursor ions are accelerated into the collision cell assembly 123 by virtue of the potential difference between the new potential at the location of the potential well where the precursor ions had been trapped and cooled, and the offset voltage of the collision cell assembly 123 ion guide. This potential difference is typically a few volts up to a hundred volts or so, for fragmentation of a particular precursor ion. As ions move through the collision cell assembly 123, they collide with background gas molecules, and such collisions cause the precursor ions to dissociate via CID, producing product fragment ions of various m/z values. The background gas pressure in the collision cell assembly 123 is maintained high enough that the CID process is efficient, but not so high that significant collision cooling of ions occurs. A typical background pressure of argon (or other commonly used collision gas such as nitrogen) would be a fraction of one millibar up to perhaps several tens of millibar. As the energy of fragmentation is typically negligible compared to the kinetic energies of the ions, the fragment ions continue traveling with essentially the same axial velocity as the precursor ions, and the entire ion population reaches the collision cell assembly 123 exit after a time period 1013 in the collision cell assembly 123 as an essentially intact, although likely somewhat broadened, ion packet. Because the possibly broad distribution of m/z values travel with similar velocities, the ion population includes a similarly broad distribution of ion kinetic energies.

Exiting the collision cell assembly 123, the ion packet, made up of fragment ions of various m/z values as well as any un-fragmented precursor ions, passes into the RF multipole ion guide assembly 124, the "Cooling Trap" referenced in FIG. 2, during filling time period 1014 indicated in FIG. 2. Time 1018 is the beginning of filling time period 1014, in which an entrance gate of the ion guide assembly 124 ("cooling trap") is in a passing state, for example, being maintained at a low voltage, such that ions pass freely into the cooling trap. Once most (e.g., all) ions of the ion packet are within the cooling trap, the entrance gate (i.e., the entrance electrode) of the cooling trap changes abruptly to a trapping state, for example, when the entrance electrode is maintained at a high voltage that imposes a potential barrier to ions that prevents them from leaving the trap through the entrance.

RF multipole ion guide assembly 124 also includes an exit electrode, referenced as "Cooling Trap Exit Gate" in FIG. 2, to which a trapping or passing voltage can similarly be applied to effect a trapping state 1005, and a passing state 1006, respectively. During a cooling trap filling time period 1014, the exit electrode is in the trapping state to prevent ions from passing through and exiting the trap through the exit end. Round-trip time is the time ions entering the RF multipole ion guide assembly 124 (the cooling trap) take to pass through the ion guide, rebound from the potential barrier at the exit end, and travel back through the ion guide to the entrance end, through which they would exit if the entrance gate was not in the trapping state by the time ions reached the entrance gate. Hence, time period 1014 is set to be shorter than the round-trip time of the ions entering through the entrance gate at time 1018.

Ions remain trapped in RF multipole ion guide assembly 124 during time period 1015 and collide with background gas molecules provided within RF multipole ion guide assembly 124. The background gas would typically be helium gas supplied at pressures of about 0.1-100 millibar to provide cooling collisions without fragmentation, although other gases could be used as well, such as nitrogen or argon. RF multipole ion guide assembly 124 also includes means for establishing an axial field that directs ions toward the ion guide exit. Examples of such means are described below in conjunction with FIGS. 4-13. Similar to the precursor ion trap exemplified by RF ion guide assembly 122, a local potential well develops proximal to the ion guide exit end of the RF multipole ion guide assembly 124", and ions accumulate in this potential well as they cool within the ion guide during the cooling time period 1015.

During ion cooling period 1015, at least a portion of the ions in the trap collision cool and settle within the potential well in section 129 proximal to the exit electrode of ion guide assembly 124. At time 1011 at the end of cooling period 1015, the state of the exit gate is abruptly switched from a trapping state 1005 to a passing state 1006. Ions that had accumulated in the local potential well section 129 proximal to the exit electrode abruptly experience a new electric field that accelerates them out as an ion packet through the exit electrode, toward the OA-TOF analyzer assembly 140 pulsing region 130.

Ions are transported from the "Cooling Trap" 124 toward and into the OA-TOF analyzer assembly 140 pulsing region 130 during time period 1016 via ion transport assembly 125. The orthogonal pulsing region 130 of OA-TOF analyzer assembly 140 conventionally includes a pair of parallel plate electrodes parallel to the axis of motion of the entering ions. During an ion filling (or ion entry) state 1008, the orthogonal pulsing region 130 is maintained at a constant potential (field-free). Ideally, most (e.g., all) ions enter the orthogonal TOF analyzer 140 pulsing region 130 have the same kinetic energy, prior to being pulse accelerated into the field-free flight tube 142. The axial kinetic energy of the ions may be adjusted to such a value upon ion entry into orthogonal pulsing region 130, by adjusting the difference between the potential of the pulsing region 130, that is, the voltages applied to the pulsing region parallel plate electrodes, and the potential at the location of the local potential well proximal to the exit electrode of the RF multipole ion guide assembly 124 when the exit electrode is operating in the passing state 1006. Either the potential of the pulsing region and/or the offset potential of the RF multipole ion guide assembly 124 and/or the potential of the exit electrode may be adjusted to ensure the proper axial kinetic energy of ions is obtained in the orthogonal pulsing region 130 during the ion filling state 1008.

Alternatively, the pulsing region 130 can include a dual-mode TOF pulsing region configuration, as described in copending application Ser. No. 14/209,982, the contents of which are fully incorporated herein by reference. With this pulsing configuration, the pulsing region acts as an RF ion guide to guide ions into the pulsing region during the 'filling' period. The offset voltage of this RF ion guide during the ion filling state establishes the potential of the pulsing region during this ion filling period, and may be adjusted similarly, as described above, to establish a selected ion kinetic energy in the pulsing region 130.

At time 1019, the orthogonal pulsing region 130 is switched from the ion filling state 1008 to an ion pulse acceleration state 1007, where pulse voltages are applied abruptly to electrodes of the pulsing region 130 to establish an electric field that accelerates ions in the pulsing region 130 orthogonal to their prior direction of travel toward the field-free flight tube 142 142 for TOF mass analysis. The pulsed acceleration field remains active until a time 1020 when most (e.g., all) ions have left the pulsing region, which is typically 1 to 20 μs or so. Thereafter the pulsing region 130 returns to the ion filling state 1008.

At time 1011, ions are released from cooling trap 124 and are accelerated and/or decelerated by axial fields during their motion from the cooling trap 124 to the TOF pulsing region 130. The timing of time 1019 is adjusted relative to the time 1011 when ions are released from the cooling trap 124 so that ions are centered within the TOF 140 pulsing region 130 at the time 1019 corresponding to the application of the TOF pulse voltages. Because ions of different m/z values will have somewhat different arrival times within the TOF 140 pulsing region 130, the time 1019 may be adjusted relative to the time 1011 so as to optimize the acceptance of the desired m/z range in the TOF analyzer 140.

Although FIG. 2 shows at time 1019 the ion pulse acceleration state 1007 of pulsing region 130 coinciding with time 1009 at which the precursor ion trap 122 exit gate switching from the trapping state 1001 to the passing state 1002, as may be the case, for example, when the same trigger control signal are used for both purposes, such a coincidence is not essential. Alternatively, the time 1009 could be later than the time 1019 to allow for a longer accumulation time period 1017 of precursor ions in the precursor ion trap. Alternatively, the time 1009 could be earlier than the time 1019 to limit the time that precursor ions are accumulated in the precursor ion trap, for example, to prevent excessive space charge in the trap.

Instead of the passing state 1006 transitioning to the trapping state 1005 at times 1009 and 1019 as shown in FIG. 2, due to the use for example, of the same trigger control signal as that used for either 1009 and/or 1019, the transition could occur as soon as essentially most (e.g., all) ions have left the cooling trap. In addition, preferably the transition does not occur before most (e.g., all) ions have traveled far enough away from the exit electrodes that they are no longer affected by the changing electric fields proximal to the exit gate of the cooling trap upon switching states from the passing state 1006 to the trapping state 1005, in order to avoid influencing the kinetic energy of released ions during this state change. Alternatively, the transition of the exit gate of the cooling trap from 1006 to 1005 could occur as late as the time of the arrival of the ions from the collision cell assembly 123.

The configuration of FIG. 1 and operating sequence of FIG. 2 provide an approach for MS/MS analysis using a TOF mass analyzer for fragment ion mass analysis that optimizes ion utilization efficiency. However, alternative, simpler configurations and operating modes are possible. For example, in another embodiment, the RF multipole ion guide assembly 122, which serves as the precursor ion trap is omitted, in which case the ions m/z selected by the mass analyzer 121 are directed continuously into the collision cell assembly 123 for CID fragmentation in the conventional manner. The resulting fragment ions and un-fragmented precursor ions exit the collision cell assembly 123 continuously and flow into the RF multipole ion guide 124 (cooling trap) while the entrance electrode of the ion guide 124 is in the passing state 1004. Background gas at elevated pressure of typically 0.1 to 50 millibar, is maintained throughout at least a portion of the RF multipole ion guide 124. The gas is preferably helium, but other gases such as nitrogen or argon could also be used.

Figure 3A:
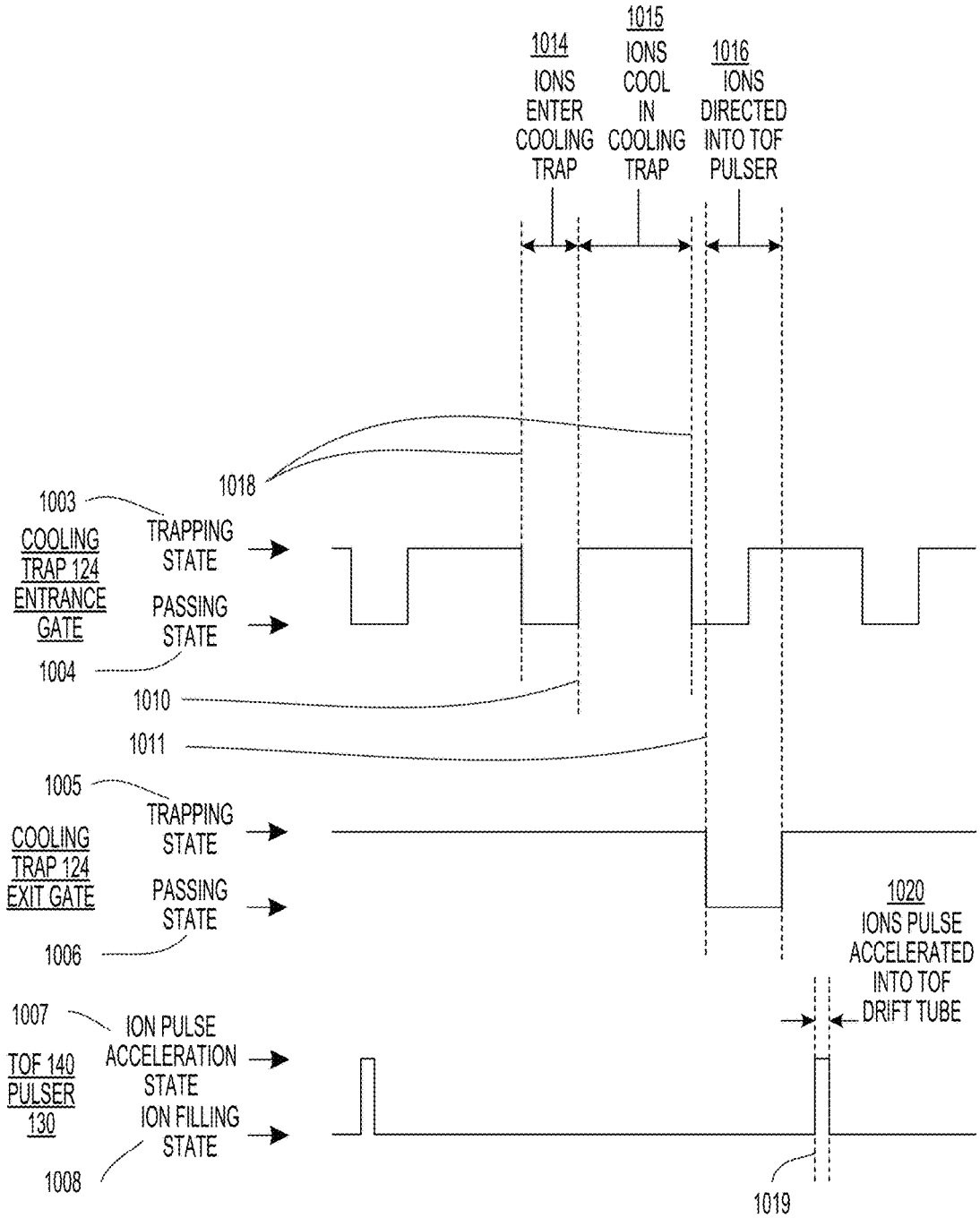
FIG. 3A shows an exemplary timing diagram used to operate the system shown in FIG. 1.

As shown in FIG. 3A, the trapping state 1003 of ion guide assembly 124 imposes a potential barrier for ion passage from the trap back out the entrance end, but also prevents more ions from passing into the trap from the collision cell during the time that the trapping state 1003 is active. After trapped ions have cooled sufficiently during the time period 1014, and have therefore accumulated within the potential well created proximal to the exit end of the ion guide assembly 124 due to the axial field (generated as described in detail below in conjunction with FIGS. 4-13) and potentials applied to the exit electrode of the assembly 124 in the trapping state 1003, as described above, the entrance gate of the assembly 124 can switch to the passing state to allow another bunch of ions arriving from the collision cell assembly 123 to enter the assembly 124. As indicated in FIG. 3A, the sequence of accepting a bunch of ions from the collision cell during time period 1014, then trapping them during time period 1015, may be executed one or more times before the exit electrode of the assembly 124 is switched from the trapping state to the passing state" at time 1011 to allow trapped and cooled ions to proceed from the local potential well proximal to the exit end of assembly 124 toward the pulsing region 130. In fact, the cycles of trapping and cooling consecutive bunches of ions from the collision cell may proceed asynchronously with the release of trapped ions toward the pulsing region 130.

To capture and cool as many ions as possible with this operating mode, the entrance electrode of the assembly 124 can switch to the passing state to allow another bunch of ions arriving from the collision cell assembly 123 to enter the assembly 124 before ions from the previous bunch or bunches have completely cooled, as long as sufficient cooling time has reduced the trapped ion kinetic energies to levels lower than a small potential barrier at the entrance electrode of the assembly 124. The small potential barrier allows ions to remain trapped in the assembly 124 instead of escaping from the assembly 124 through the entrance electrode and also allows ions of sufficient kinetic energy coming from the collision cell to pass into the assembly 124.

The trapping of ions within RF multipole ion guides 122 or 124 using potential barriers at both the entrance and exit ends of the ion guide, allows ions to be subjected to collision cooling for an extended time period. This allows such collision cooling to occur with much lower collision gas pressures than would otherwise be needed if ions were not trapped, but instead only passed through the ion guide, as with conventional collision cells. This lower gas pressure therefore provides an advantage that lower vacuum levels can be maintained elsewhere in the system, and/or reduced, less expensive pumping can be employed. Alternatively, even simpler embodiments are possible by eliminating the assembly 124, and providing high enough collision gas pressures within collision cell assembly 123 that collision cooling occurs within the collision cell assembly 123. The collision cell assembly 123 is then also provided with an axial field, according to the methods and apparatus disclosed herein.

Alternatively, the RF multipole ion guide assembly 124 having an axial field, according to the methods and apparatus disclosed herein, could be operated in a pass-through, non-trapping mode, provided that the RF multipole ion guide assembly 124 was provided with collision cooling gas pressure high enough to efficiently collision cool ions coming from the collision cell. In this case, ions would not be trapped within the RF multipole ion guide assembly 124, but would pass through directly while experiencing collision cooling during their passage. Higher collision gas pressures are used to obtain efficient collision cooling than if the ions had been trapped for an extended period of time 1015 within RF multipole ion guide assembly 124, during which the ions traverse the length of the ion guide assembly 124 multiple times.

The TOF duty cycle efficiency in the former case would then also be less than if the ions had been trapped within RF multipole ion guide assembly 124 and periodically released to the TOF 140 pulsing region 130, because ions in the ion beam flowing into the TOF pulsing region between pulse-acceleration events would be lost. Nevertheless, the axial field generated within RF multipole ion guide 124 according to the methods and apparatus disclosed herein serve to prevent ion loss within the ion guide 124 due to complete collision cooling and consequent ion stagnation within the ion guide 124.

In another embodiment, the "Precursor Ion Trap" 122 of FIG. 1 includes not only an "Exit Gate", but also an "Entrance Gate". Such an "Entrance Gate" operates with a "Passing State", where ions are facilitated to pass from the mass analyzer 121 into the "Precursor Ion Trap" 122, or in a "Gated State", where ions are prevented from passing from the mass analyzer 121 into the "Precursor Ion Trap", and are lost. By controlling the time during which the "Precursor Ion Trap" 122 "Entrance Gate" is in the "Passing State", the number of ions of a particular precursor m/z value can be adjusted in a controlled, quantitative manner, which enables quantitative dynamic range adjustments. That is, low intensity ions can be accumulated and collision cooled for a known extended period of time before being accelerated into the collision cell assembly 123, by operating the "Entrance Gate" of the Precursor Ion Trap 122 in the "Passing State" for an extended period of time, such as the time period 1017 in FIG. 2. Alternatively, high intensity ions can be allowed to pass into the "Precursor Ion Trap" 122 from the mass analyzer 121 for a much shorter time, then collision cooled and accelerated into the collision cell assembly 123 for CID.

Figure 3B:
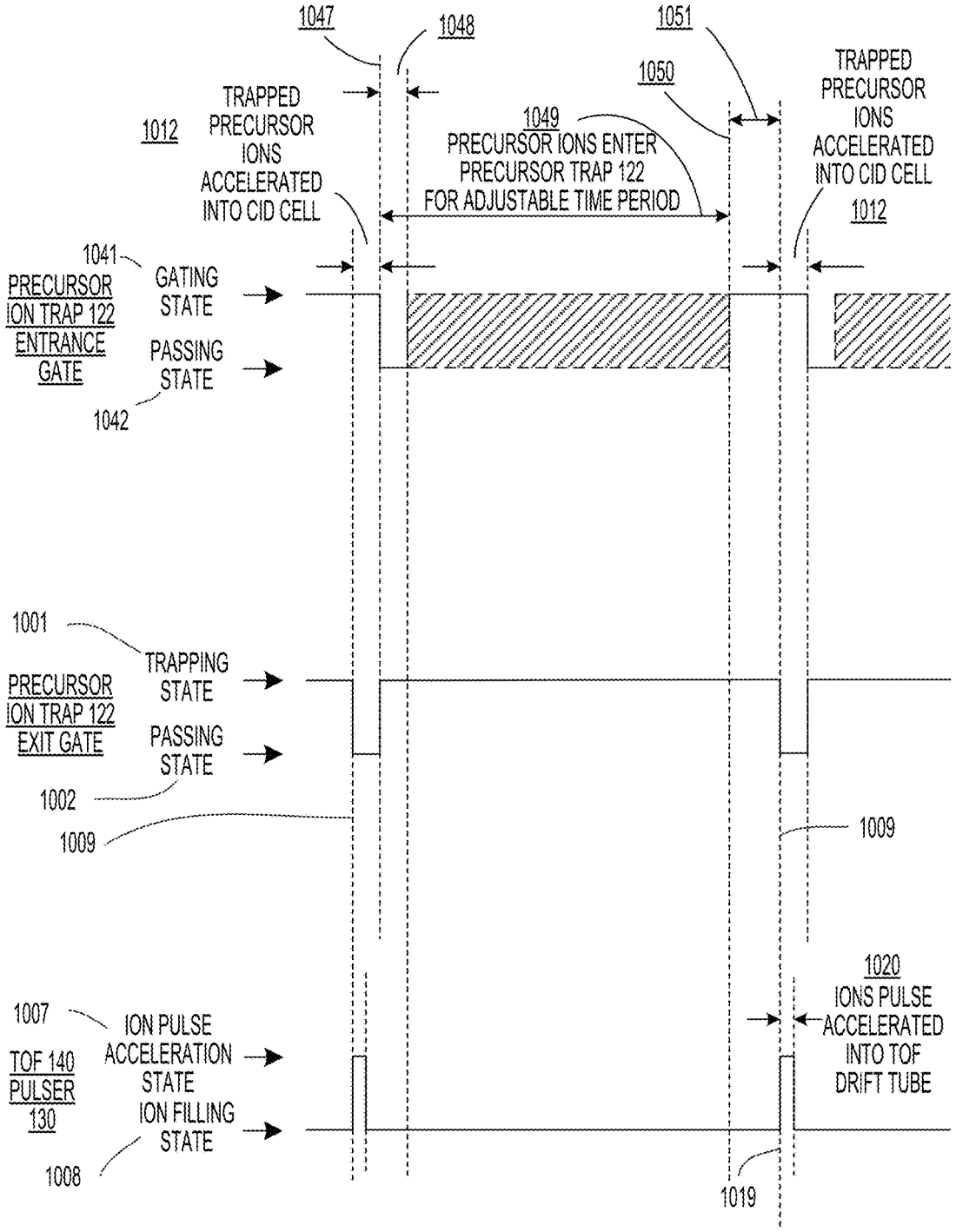
FIG. 3B shows an exemplary timing diagram used to operate the system shown in FIG. 1.

The exemplary timing diagram of FIG. 3B demonstrates one possible approach for regulating the ion flux in a quantitative manner that facilitates dynamic range adjustment. At a time 1047 proximal to the time at the end of time period 1012 when trapped precursor ions are accelerated into the collision cell assembly 123, the "Precursor Ion Trap 122 Entrance Gate" is switched from the "Gating State" 1041 to the "Passing State" 1042 to allow precursor ions to resume passing from the mass analyzer 121 into the "Precursor Ion Trap" 122. The time period during which precursor ions are allowed to pass into the "Precursor Ion Trap" 122 may be adjusted as needed from a minimum time period 1048 to some adjustable time period 1049. At an end 1050 of this adjustable time period 1049, the "Precursor Ion Trap 122 Entrance Gate" is switched from the "Passing State" 1042 to the "Gating State" 1041 to again prevent additional precursor ions from passing from the mass analyzer 121 into the "Precursor Ion Trap" 122. The ions that were admitted into the "Precursor Ion Trap" 122 are allowed to collision cool and accumulate proximal to the exit end of the "Precursor Ion Trap" 122 during a time period 1051. At the end 1009 of time period 1051, the "Precursor Ion Trap 122 Exit Gate" switches from the "Trapping State" 1001 to the "Passing State" 1002 during time period 1012, and trapped and cooled precursor ions are accelerated into the collision cell 123 for CID fragmentation. The operation of CID fragmentation in collision cell 123, trapping and cooling in cooling cell 124, transfer via transfer optics 125, and mass analysis in TOF analyzer 140, then proceeds as described above in connection with the timing diagram of FIG. 2. Concurrent with these steps of fragmentation, trapping and cooling in the cooling cell, transfer to the TOF and TOF mass analysis, a subsequent bunch of precursor ions are being allowed to pass into the "Precursor Ion Trap" 122 from mass analyzer 121 during adjustable time period 1049.

This enables a mode of quantitative dynamic range extension, whereby the time period 1049 when precursor ions are allowed to pass from the mass analyzer 121 into the "Precursor Ion Trap" 122 is adjusted by a known quantitative amount, as follows. The signal intensity range (range of ion flux) that can be accommodated by the detector system and acquisition electronics is typically limited for a fixed set of operating parameters, specifically a fixed signal gain or amplification, such that when operating at a gain or amplification that provides good sensitivity for small signals, large signals will then cause saturation of the detector system and/or acquisition electronics, which precludes quantitative measurements of such large signals.

However, the signal levels actually measured by the TOF analyzer for a given ion intensity depend linearly on the time period 1049 that ions are allowed to accumulate within "Precursor Ion Trap" 122. In other words, for a given ion flux, the ion intensity measured in the TOF analyzer varies linearly with the time 1049 that the ions were accepted, cooled, trapped, and released in the "Precursor Ion Trap" 122. Therefore, for example, for an ion flux that was beyond the dynamic range of the detector system and/or acquisition electronics, the time period 1049 can be reduced by a known amount, thereby reducing the ion flux into the TOF analyzer proportionately, such that the ion flux measured in the TOF analyzer is within the dynamic range of the detector system and acquisition electronics. This known proportional reduction can then be used to re-scale the ion signal measured in the TOF analyzer accordingly, resulting in an effective extension of the signal dynamic range.

In the description that follows, charged particles generated by ion source 110 are assumed to be positive ions, nonetheless it should be understood that the systems disclosed herein work just as well for negative ions or electrons, in which cases the voltages applied to the various electrodes of the system 100 would be of the opposite polarities from those described below.

Further, the following embodiments include linear RF ion guides, but it should be understood that curved RF ion guides can also be used.

Turning now to specific examples of embodiments, FIGS. 4A-4D are schematic diagrams of an RF ion guide 400.

Figure 4A:
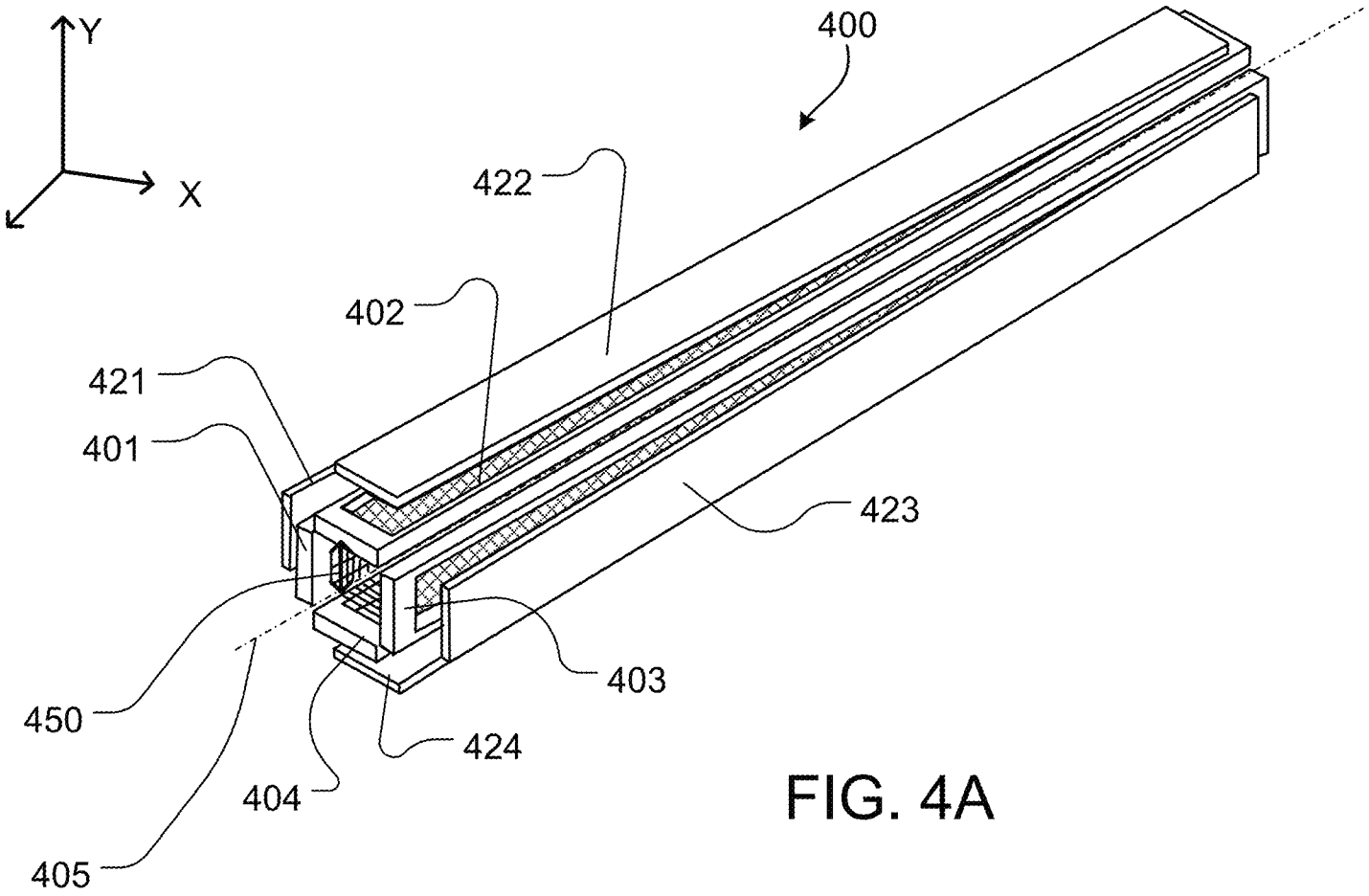
FIG. 4A shows a rectilinear ion guide assembly having partially-transparent RF electrodes and external auxiliary electrodes having a tilt angle relative to the ion guide axis.

The RF ion guide 400 of FIG. 4A is configured as a rectilinear quadrupole ion guide, in which each of the four RF electrodes 401, 402, 403 and 404 are constructed from flat plates arranged in parallel and with a square cross-section. RF electrodes 401-404 are, for example, planar conductors. Each RF electrode 401-404 is the same minimum distance 450 from a common axis 405. The RF electrodes 401-404 extend the length 451 of the ion guide 400 from an entrance end 440 to an exit end 441. In other words, as shown in FIG. 4A, RF electrodes 401-404 of the ion guide 400 extends along the common axis 405, which is an ion guide axis. RF electrodes 401 and 403 are electrically connected together and connected to a first phase of an RF voltage generator (not shown), while RF electrodes 402 and 404 are also connected together and connected to the opposite phase (180 degrees from the first phase) of the RF voltage generator, as is conventional for RF quadrupole ion guides. A DC offset voltage generated by a DC voltage supply (not shown) is also provided to which the RF voltages are referenced in the conventional fashion.

Figure 4B:
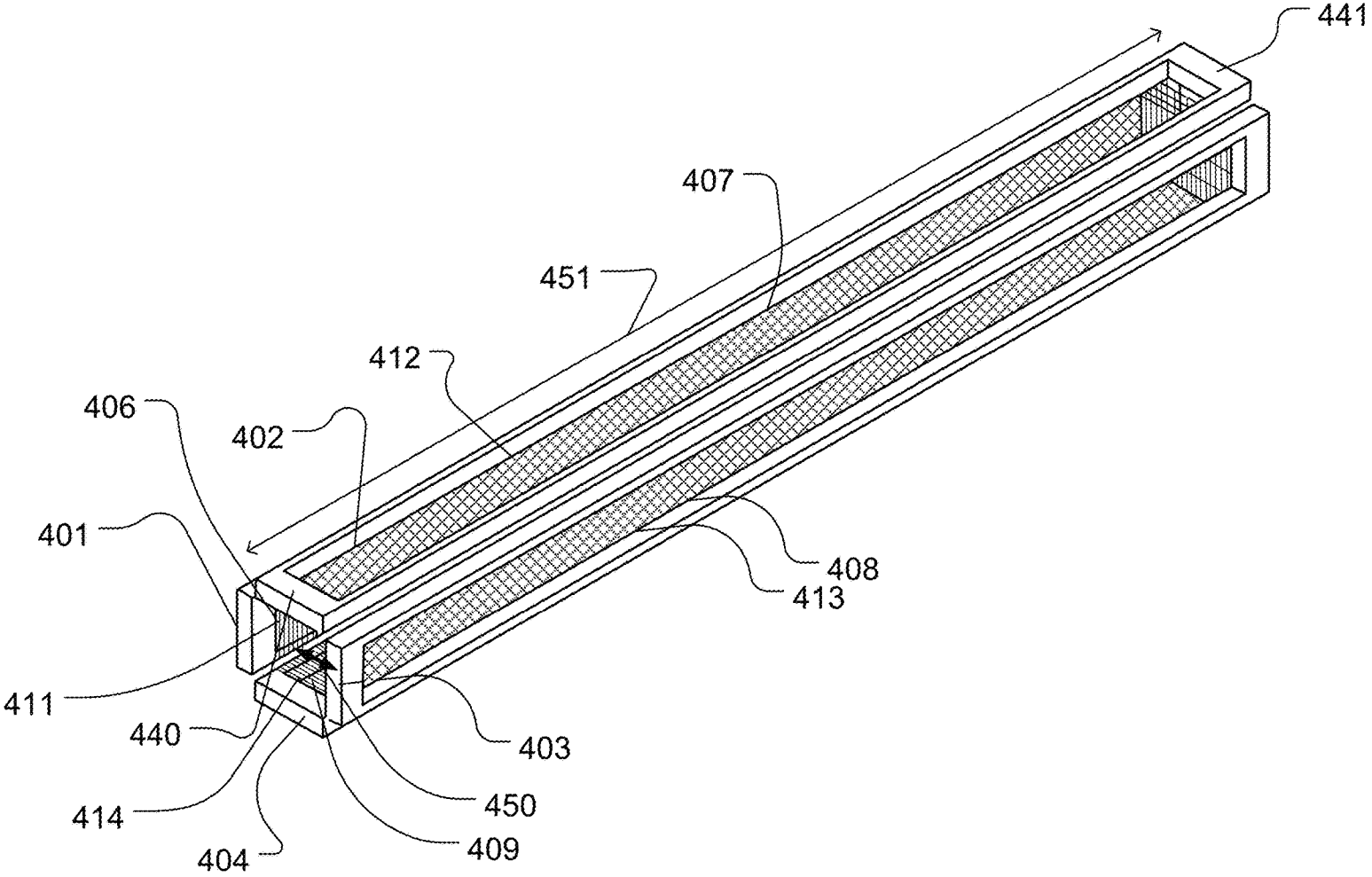
FIG. 4B shows the partially-transparent RF electrodes of the rectilinear ion guide of FIG. 4A.
Figure 4C:
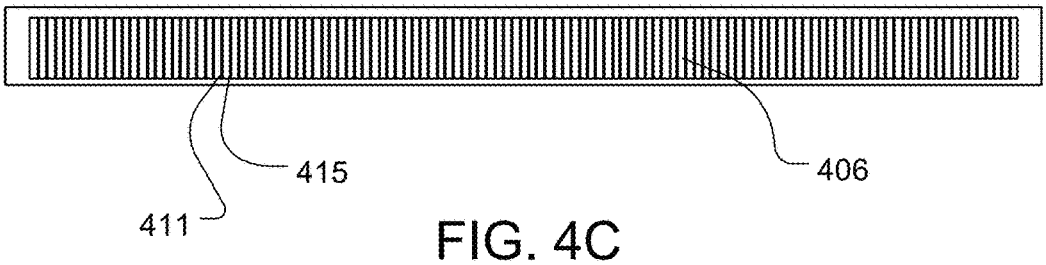
FIG. 4C shows one partially-transparent RF electrode of FIG. 4A.
Figure 4D:
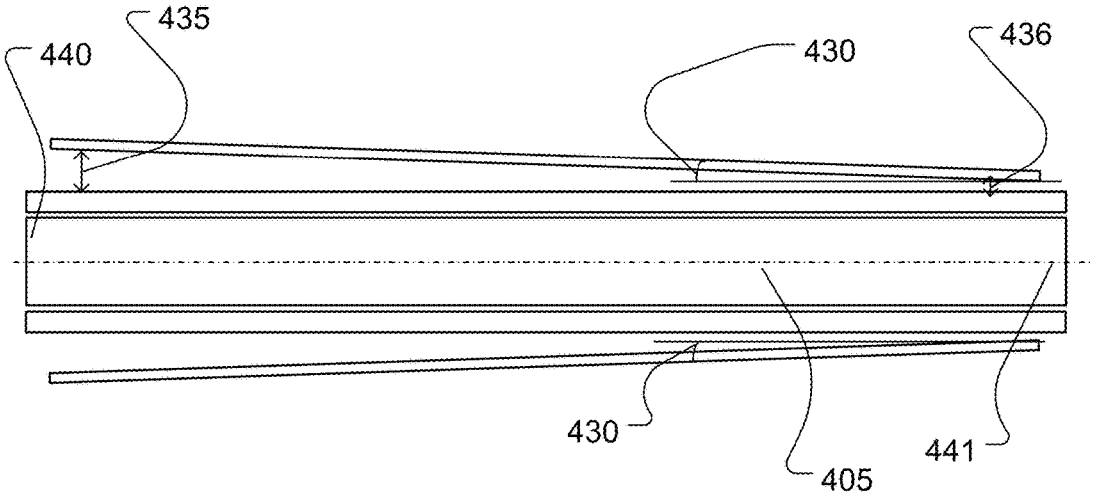
FIG. 4D shows a side view of the rectilinear ion guide assembly of FIG. 4A.

Each of the four flat plate RF electrodes 401-404 include an opening 406, 407, 408 and 409, respectively, completely through each electrode 401-404 as shown in FIG. 4A-4C, except for arrays 411, 412, 413 and 414 of grid wires 415 located within the openings 406-409, respectively. The openings 406-409 each extend across the same portion of the width of each electrode and along the same portion of the length of each electrode. The arrays 411-414 of wires 415 essentially form a flat surface on each RF electrode 401-404 in place of the portion of the original surfaces closest to the ion guide axis 405 that are absent by virtue of the openings 406-409 in the electrodes 401-404. The arrays 411-414 of wires 415 are electrically connected to the RF electrodes 401-404, respectively, and so have the same RF voltages applied as their respective RF electrode to which they are attached. As such, the RF electrodes 401-404 produce essentially the same RF electric fields within at least the central portion of the ion guide as with conventional solid plate RF electrodes.

Also shown in FIG. 4A are four auxiliary electrodes 421, 422, 423 and 424, each auxiliary electrode being positioned proximal to the outer face of the RF electrodes 411, 412, 413 and 414, respectively. The auxiliary electrodes 421-424 are positioned centered longitudinally and laterally next to the RF electrodes 401-404, respectively. The auxiliary electrodes are, for example, planar conductors. However, the auxiliary electrodes 421-424 are each positioned at a tilt angle 430 with respect to the ion guide axis along their length, such that the distance of the auxiliary electrodes 421-424 from the inner surfaces of the RF electrodes 401-404 including the arrays 411-414 of wires 415, respectively, decreases from the distance 435 proximal to the entrance end 440 of the ion guide 400 to the distance 436 proximal to the exit end 441 of the ion guide 400. ADC voltage is applied to all of the auxiliary electrodes 421-424 from an auxiliary DC voltage generator (not shown). When this auxiliary DC voltage is different from the DC offset voltage applied to the RF electrodes 401-404, an auxiliary DC electric field is developed between the auxiliary electrodes 421-424 and the RF electrodes 401-404. The auxiliary DC electric field increases along the length of the ion guide 400 as the distance between the auxiliary electrodes 421-424 and RF electrodes 401-404 decreases along the ion guide 400 length by virtue of the tilt angle 430.

An electric field present on one side of a semi-transparent grid influences the electric fields on the other side of the grid, and vice-versa, due to the presence of the openings in the grid. Therefore, because a portion of the RF electrodes 401-404 include arrays 411-414 of wires 415 within the open areas 406-409, respectively, the auxiliary DC electric field penetrates more or less through the spaces between the wires 415, and modifies the potentials within the ion guide 100 (e.g., along the ion guide axis 405). The degree of this penetration and the influence of the auxiliary field on the potentials within the ion guide depend on the transparency of the arrays 411-414 and on the magnitude of the auxiliary DC field. For the ion guide 400 depicted in FIGS. 4A-4D, the magnitude of the auxiliary DC field increases along the length of the ion guide 400 from the entrance end 440 to the exit end 441, resulting in a corresponding increase in the influence of the auxiliary DC field on the potentials within the ion guide and, in particular, within the central portion of the ion guide along the ion guide axis 405. In other words, an electric field at the ion guide axis 405 results that has a non-zero axial component.

In order to demonstrate this field penetration effect, a computer simulation model of ion guide 400 was defined with the Simion 8.1 ion optics modeling software available from Scientific Instrument Services, Inc., Ringoes, N.J. The model was defined with the following characteristics: The closest distance 450 from the ion guide axis 405 to the inner faces of (any one of) the RF electrodes 401-404 is 5.0 mm. The width, length, and thickness of each RF electrode 401-404 are 9.0 mm, 125.0 mm, and 2.0 mm, respectively. The corresponding dimensions of the opening 406-409 in each RF electrode 401-404 are 7.0 mm by 119.0 mm. The wires 415 have a square cross-section and a 0.2 mm edge dimension, and are spaced apart with a 1.0 mm spacing along the 119.0 mm length of each of the openings 406-409. The auxiliary electrodes 421-424 are also 9.0 mm in width, and 119.0 mm in length. They are positioned at a tilt angle 430 of 1.5 degrees with respect to the ion guide axis, and spaced apart from the RF electrodes 401-404 such that the distance 435 is 6.1 mm while the distance 436 is 3.0 mm. The auxiliary electrodes 421-424 are positioned so as to be centered over the openings 406-409 in the RF electrodes 401-404, respectively.

A DC voltage of 0 V was applied to each of the RF electrodes 401-404, while a DC voltage of −100 V was applied to each auxiliary electrode 411-414. Using the Simion software, the potential distribution was calculated by solving the Laplace equation. The resulting potential distribution 510 along the axis 405 is shown in FIG. 5A.

The potentials near the ion guide entrance end 440 and the ion guide exit end 441 are strongly influenced by ion guide fringe field effects, in particular, by the proximity of these regions to the auxiliary electrodes having −100 V applied. However, for axial positions far from the ends (for example, away from the ends by about 20 mm), the axial potential decreases by about 500 mV over about 85 mm, that is, by about 59 mV per cm. This axial potential gradient, or axial field, is similar to axial fields typically used to ensure rapid transit of ions through background gas of sufficient pressures to cause CID and/or collision cooling of ions.

The axial field exhibited in this model simulation was due primarily to penetration of the auxiliary field through the array of wires, rather than fringing effects from the open end regions, or penetration of the auxiliary field through the gaps between the RF electrodes. This was verified by defining a computer model geometry that was identical to the model used above, except that the gaps between the RF electrodes at their corners, and the ion guide ends, were closed. To this end, the RF electrode widths were increased to 7.0 mm, resulting in the 'X' and 'Y' RF electrodes coming together at the four ion guide corners. The ion guide ends were completely closed by a square 5.0 mm by 5.0 mm by 1 mm thick flat plate electrode positioned between, and connected to, the four RF electrode ends, thereby sealing the entrance and exit ends.

Figure 5A:
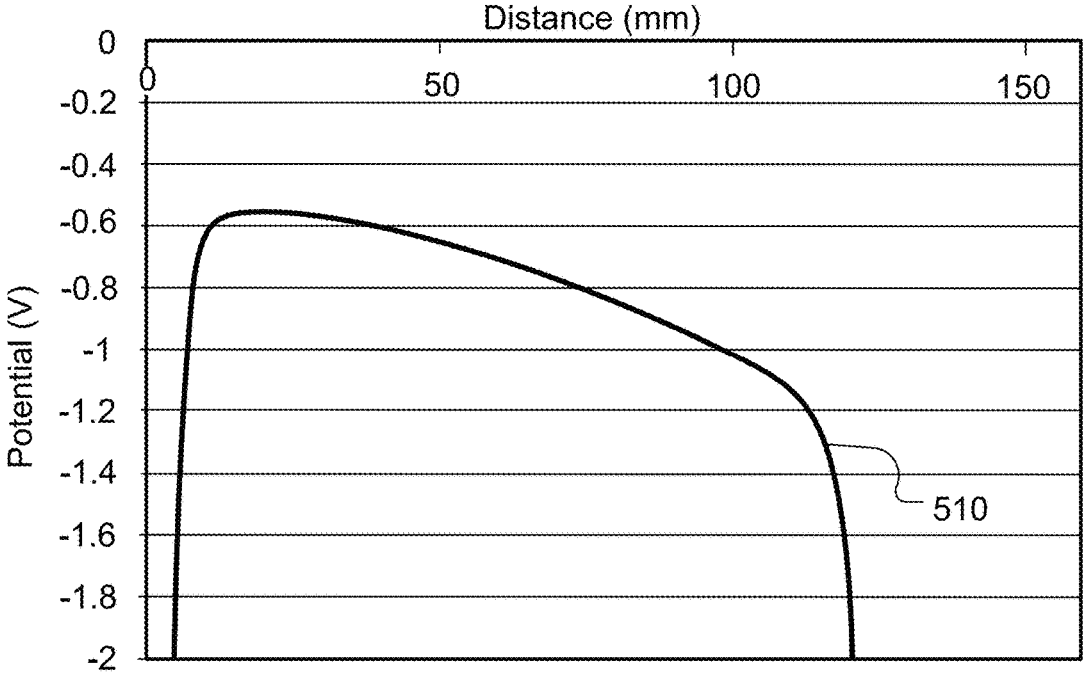
FIG. 5A shows a calculated axial potential distribution of the ion guide assembly of FIG. 4A.
Figure 5B:
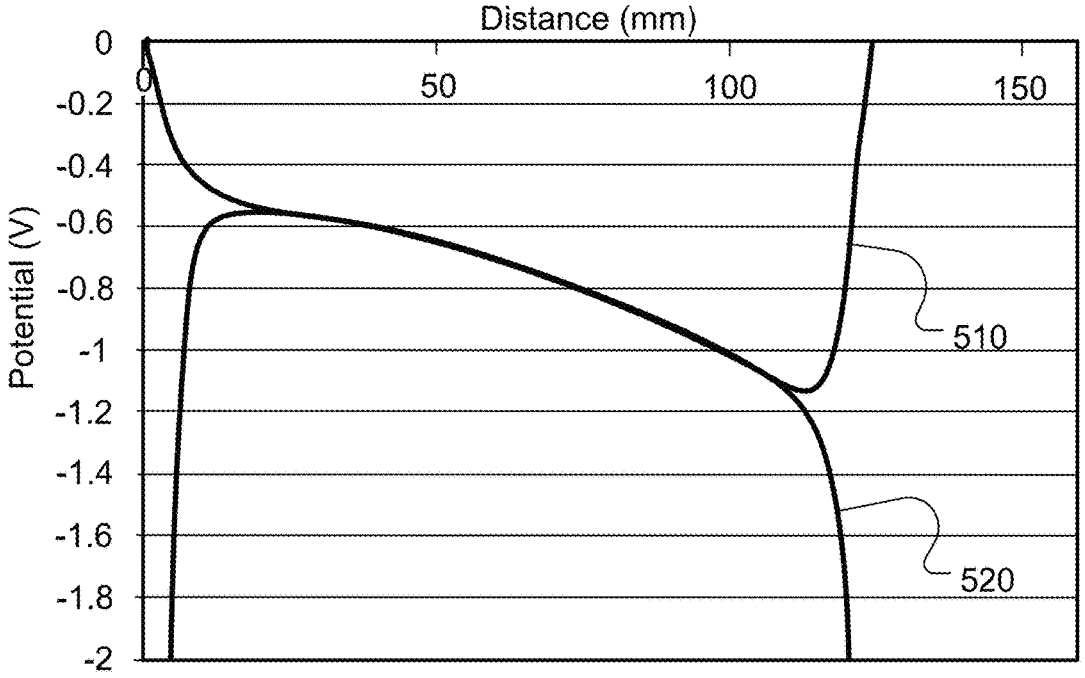
FIG. 5B shows a calculated axial potential distribution of FIG. 5A, and a potential distribution calculated for an ion guide assembly that is identical to that of FIG. 4A except that all gaps between RF electrodes were 'filled-in' so as to completely isolate the ion guide axis from external fields except through the transparent portions of the RF electrodes.

The potential distributions were again calculated, and the resulting axial potential distribution 520 is plotted in FIG. 5B, along with the potential distribution 510 from FIG. 5A.

The axial potential distributions are seen to be essentially identical except for axial distances from the ends of about 15 mm. This demonstrates that the varying axial potentials generated in the ion guide 400, away from the ion guide end fringe field regions, is due primarily to the penetration of the varying auxiliary field through the openings in the RF electrodes.

Figure 5C:
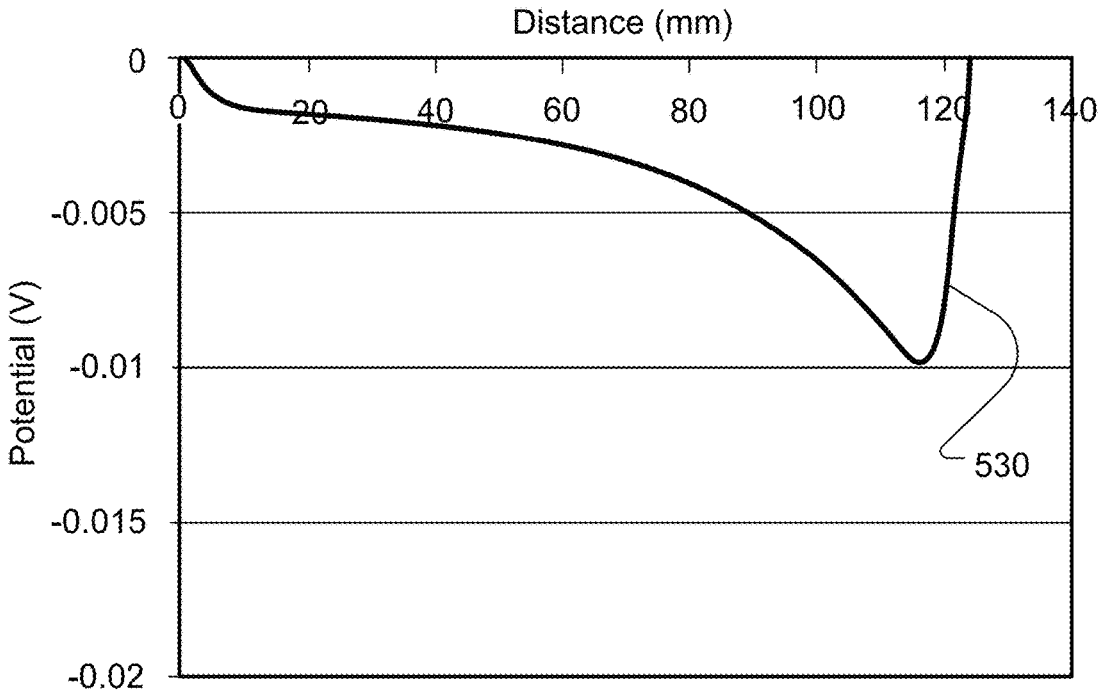
FIG. 5C shows a calculated axial potential distribution of a rectilinear ion guide that is conventional except for closed ends as in FIG. 5B, where auxiliary electrodes are positioned along the corners of the ion guide, so as to provide field penetration through the gaps between the ion guide RF electrodes.

In fact, because the gaps between the RF electrodes at the corners of a rectilinear ion guide are typically small, significant field penetration through to the ion guide interior is precluded. This is demonstrated using another model geometry, which is similar to the geometry of FIGS. 4A-4D, except that the RF electrodes 401-404 now contain no openings 406-409, nor arrays 411-414 of wires 415, but are simply solid plate electrodes. Also, in order to eliminate any field penetration due to fringe fields at the ion guide end regions, the ion guide ends were completely closed by a square 5.0 mm by 5.0 mm by 1 mm thick flat plate electrode positioned between, and connected to, the four RF electrode ends, thereby sealing the entrance and exit ends. Further, the auxiliary electrodes now take the form of round rods 2.0 mm in diameter positioned at the four corners of the rectilinear ion guide, proximal to the four gaps, respectively, between the abutting RF electrodes, in order to ensure maximum field penetration through the gaps. The round rod auxiliary electrodes were positioned at an angle of 1.5 degrees from the ion guide axis, such that the distance from the axis to the closest surface of the rods varied from 10.1 mm to 7 mm over an axial length of 119 mm. Voltages of 0 V and −100 V were applied to the RF electrodes and auxiliary electrodes, respectively, and the resulting axial potential distribution 530 is shown in FIG. 5C.

In comparison with the results of FIG. 5B, it is evident that such an approach of deploying DC auxiliary electrodes to generate an axial potential gradient in a quadrupole RF ion guide having solid flat plate electrodes, is much less effective than the approach based on the ion guide 400 of FIGS. 4A-4D. Specifically, with a differential DC offset voltage of 100 V between the RF electrodes and the auxiliary electrodes, and the same tilt angle of the auxiliary electrodes with respect to the ion guide axis, the maximum difference in axial potentials was on the order of about 500 mV for the ion guide 400, while only about 10 mV for RF electrodes that are simply solid plate electrodes.

Figure 15D:
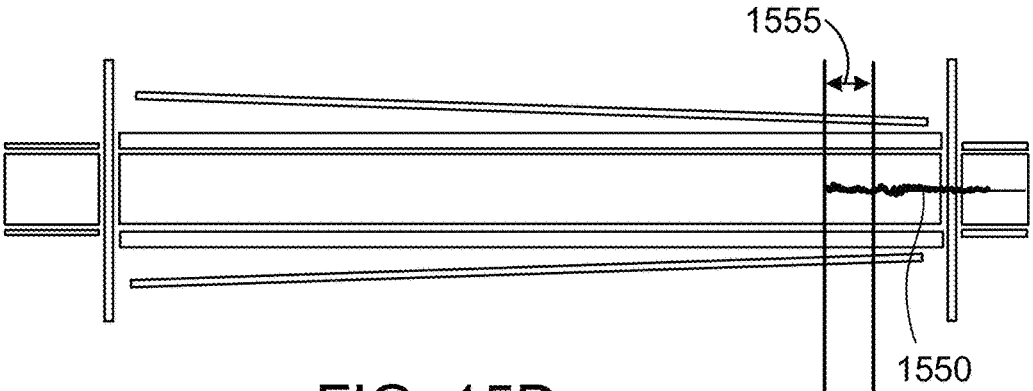
FIG. 15D shows ion trajectory calculation using the assembly of FIG. 4 after the exit potential barrier of FIGS. 15A-C is removed.

An example of operation of such an RF ion guide assembly is shown in FIG. 15A-15D. FIG. 15A illustrates the RF ion guide assembly 400 of FIG. 4, with the addition of entrance aperture electrode 1526, exit aperture electrode 1528, ion transport RF ion guide 1527 upstream of entrance aperture 1526, and ion transport RF ion guide 1528 downstream of exit aperture 1528. The same RF voltages with amplitude of 200 V were applied to ion guide 1527, ion guide 1529, and the RF electrodes 401-404. The RF offset voltages of these ion guides were −30 V for ion guide 1527, −30 V for the ion guide of assembly 400, and −50 V for ion guide 1529. The voltage applied to entrance aperture 1526 was also −30 V. In the trapping mode depicted in FIGS. 15A-15C, the voltage applied to the exit aperture was 0 V. Additionally, a voltage of −500 V was applied to auxiliary DC electrodes 421-424 of ion guide assembly 400. The potentials within this configuration were determined with the Simion program, and the calculated axial potential distribution corresponding to these voltages in this trapping mode is plotted in FIG. 15C as the axial potential in volts vs. axial position.

Simulated ions were launched with the Simion program for this calculation starting within the upstream RF ion guide 1527, having a m/z of 502 u, and an axial kinetic energy of 30 eV. The ions are seen in the resulting ion trajectories 1550 depicted in FIG. 15A to pass through the ion guide 1527, through the entrance aperture 1526, and into the RF ion guide assembly 400. Once the ions entered the ion guide assembly 400, the trajectory calculation program included the effects of collisions with background gas molecules. In this simulation, the background gas was taken to be helium at a pressure of 20 milliTorr, and the collision cross-section for these ions with helium was taken to be $2.3\times10^{-18}$ $m^2$. The ions are observed to pass through to the region proximal to the exit aperture 1528, but are stopped and turned around by the potential barrier imposed by the potential applied to the exit aperture electrode 1528. However, the axial field generated by the tilted DC auxiliary electrodes 421-424 having −500 V applied maintains a forward-directed acceleration field. Ions therefore eventually stop moving upstream, turn around and are again directed downstream towards the exit aperture 1528, where they again are turned around by the potential barrier. All this time, the ions are colliding with the background gas molecules and losing kinetic energy in the process, or 'cooling'. After several such traverses along the assembly 400, the ions eventually lose essentially most (e.g., all) their kinetic energy and settle down within the local potential well created by the combination of the potential barrier proximal to the exit electrode 1528 and the axial field created by the tilted auxiliary DC electrodes 421-424. The time for this 'relaxation' of ions into the local potential well was on the order of 500 microseconds, which is the flight time depicted in FIG. 15A. The ion trajectories calculated from 500 microseconds to 1000 microseconds is shown in FIG. 15B, in which it is demonstrated that the ions have 'settled' and are trapped within the local potential well in the region 1555.

Figure 15E:
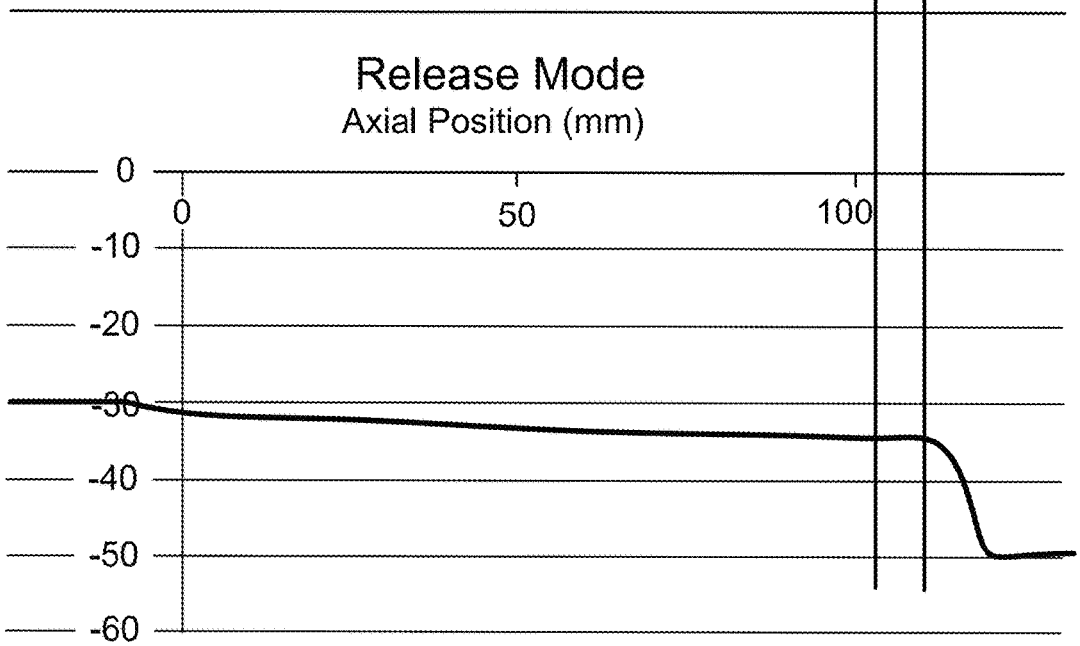
FIG. 15E shows a calculated axial potential distribution with the exit potential barrier of FIGS. 15A-C removed.

At the flight time of 1000 μs from the ions' start, the voltage applied to the exit aperture electrode 1528 was changed from 0 V to −50 V. The axial potential distribution that results from this new condition is plotted in FIG. 15E. In this condition, the potential barrier is removed, and ions experience an axial acceleration from the positions they had in the local potential well to the exit aperture, and FIG. 15D shows the resulting ion trajectory calculations through the exit aperture 1528 and through the downstream transport ion guide 1529.

The tilted auxiliary electrodes 421-424 extend along the ion guide axis and is non-parallel to the ion guide axis. Without the axial field generated by the tilted auxiliary electrodes 421-424, the ions would only have experienced the potential barrier proximal to the exit aperture electrode 1528, and, while the ions would have been trapped within the ion guide assembly 400, they would have been free to move throughout the ion guide. Therefore, at the time for their release through the ion guide exit aperture electrode, their broad distribution through the ion guide would result in a much longer time period for their downstream transmission. For example, ions arrived at the same axial location downstream of the exit aperture electrode within a time frame of about 200 microseconds for the above simulation with the axial field. However, without the axial field, but otherwise applying the same voltages and timings, it was found that ions can take between about 500 microseconds to about 10 milliseconds to exit the ion guide and reach the same downstream axial location. In fact, about 10% of the ions drifted over this time frame in the upstream direction and exited the ion guide through the entrance aperture, resulting in their loss.

The openings in the RF electrodes through which the auxiliary DC fields penetrated in the embodiment shown in FIG. 4A-4D were created by an array of wires spaced apart from each other by a constant spacing. In this way, the DC electrode generates an electric field that impinges on the ion guide axis 405. Spacing between wires in the array of wires serves as apertures through which electric field can pass through, in a direction perpendicular to the ion guide axis 405. Alternative embodiments include similar wire arrays having different spacing; different diameter wires; wires oriented differently, such as at oblique angles or even longitudinally along the axis; crossed wires, as with a wire mesh; or a similar array of openings could be formed as an integral feature of the RF electrodes themselves, such as machined holes or slots. Openings in the RF electrodes covered by the array of wires could also be of different sizes in width and/or in length, and/or the RF electrodes could be of a different thickness. Different tilt angles and/or different spacing between the auxiliary electrodes and the RF electrodes can also be used. Further, the auxiliary electrodes could take the shape of square or round rods or even wires.

Further, the dependence of the axial potential on axial position is non-linear with the flat auxiliary electrodes as shown in FIGS. 5A and 5B. Nonetheless, auxiliary electrodes that were curved, that is, with which the radial distance between the ion guide axis and the electrode surface varied along the ion guide axis with a non-linear dependence can also be used. For example, a linear axial potential distribution could be achieved by curving the shape of the auxiliary electrodes such that the distance to the auxiliary electrode from the axis decreased more rapidly at the large separation end than at the small separation end with a particular non-linear dependence. In even other embodiments, the auxiliary electrodes could be parallel to the RF electrodes, but the auxiliary electrodes could be segmented, with a different auxiliary DC voltage applied to different segments such that the auxiliary DC field varies along the length of the ion guide, which, in turn, results in an axial field in the ion guide via semi-transparent RF electrodes. Further, the auxiliary electrodes could be parallel and continuous, but formed from a resistive material or have a resistive coating, such that a DC voltage applied between the auxiliary electrode ends creates an auxiliary DC field that varies along the ion guide length, thereby creating an axial field within the ion guide via semi-transparent RF electrodes.

Figure 6A:
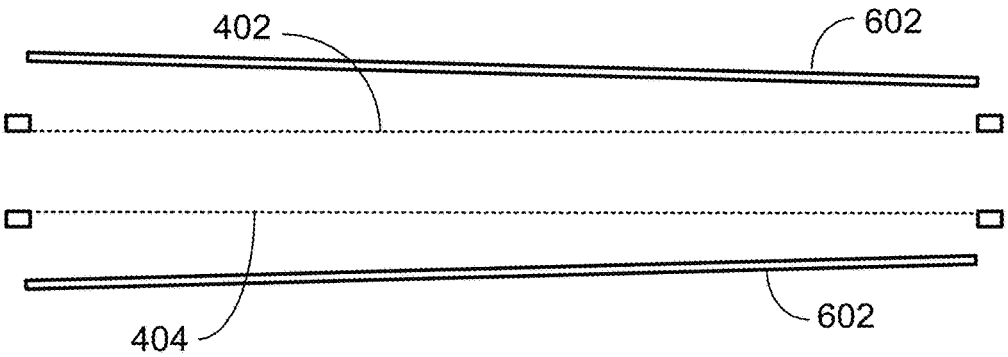
FIG. 6A shows an assembly of the rectilinear ion guide RF electrodes of FIG. 4A having a DC auxiliary electrode configured as a truncated cone.

Even further, the auxiliary electrodes could take the form of a continuous enclosure surrounding the RF electrodes, which could have a square or circular cross-section which decreases in cross-section size along the ion guide axis to create a tapered contour along the axis. An example of the cross-section of such a structure is shown in FIG. 6A for the case of a circular truncated cone auxiliary electrode 602 which has the auxiliary DC voltage applied, surrounding the RF electrode structure 401-404 of FIGS. 4A-4D, in place of the four separate auxiliary electrodes of ion guide 400 shown in FIGS. 4A-4D.

Figure 6B:
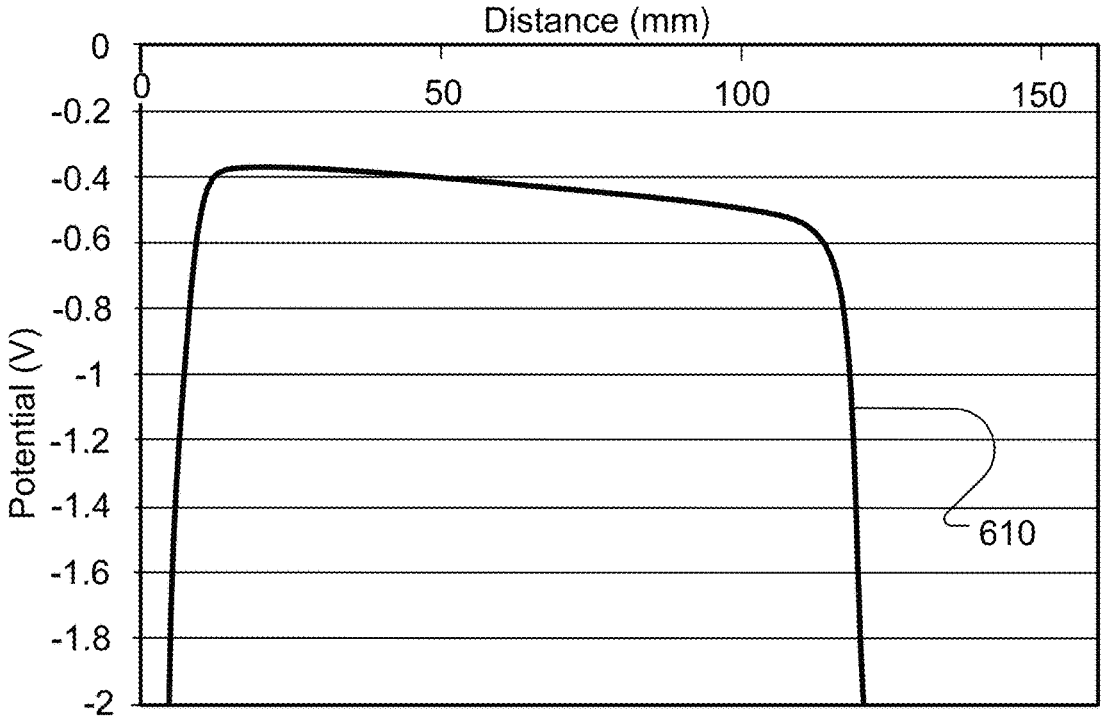
FIG. 6B shows a calculated axial potential distribution for the assembly of FIG. 6A.

The resulting calculated axial potential distribution 610 for this embodiment is shown in FIG. 6B. In comparison with the potential distribution of FIG. 5A, the axial field is found to be somewhat weaker, that is, a maximum potential difference along the axis of about 150 mV compared to about 500 mV as shown in FIG. 5A, for the same 100 V differential voltage between the auxiliary electrode DC voltage and the RF offset voltage. This is expected due to the greater distance that the circular conical auxiliary electrode is from the RF electrodes, which is 14 mm at the entrance end and 10.9 mm at the exit end, so that the inner diameter of the conical electrode clears the corners of the RF electrodes. Nevertheless, an axial potential gradient similar in amplitude to the geometry of FIG. 4 can easily be achieved by increasing the voltage on the conical auxiliary electrode of the geometry of FIG. 6.

The openings in the RF electrodes do not have to be an array of openings, as with an array of slots or an array of wires being separated by gaps, thereby maintaining the RF electrode flat surface, but rather could just as well be a relatively small but continuous opening in each RF electrode that is each completely transparent to auxiliary electric fields. In this case, a reasonable approximation of the RF electrode surfaces to flat plate is retained by reducing the width of the openings. An example of such an embodiment is shown in FIG. 7A.

Figure 7A:
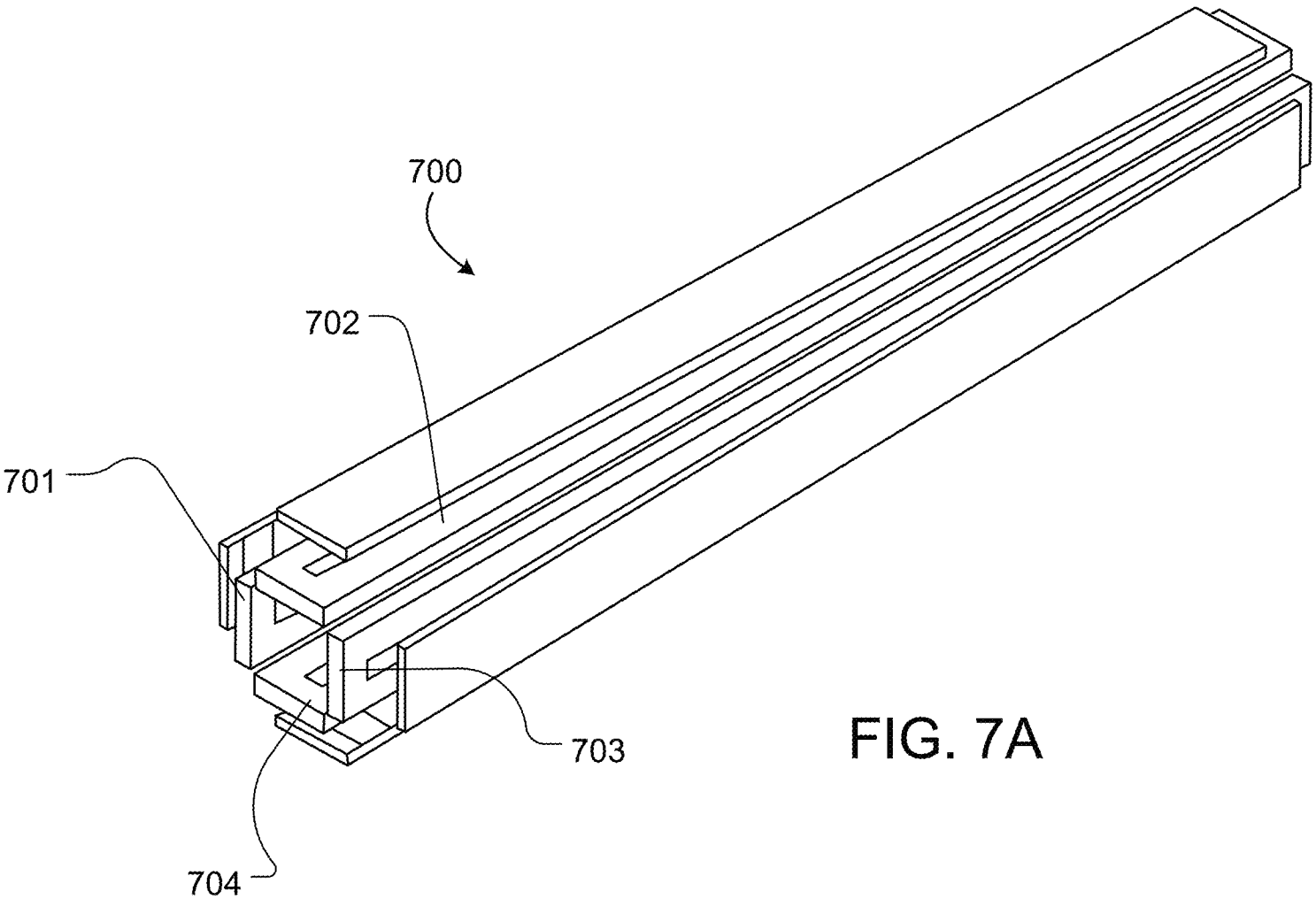
FIG. 7A shows a rectilinear ion guide assembly in which the RF electrodes are configured with a longitudinal slow.
Figure 7B:
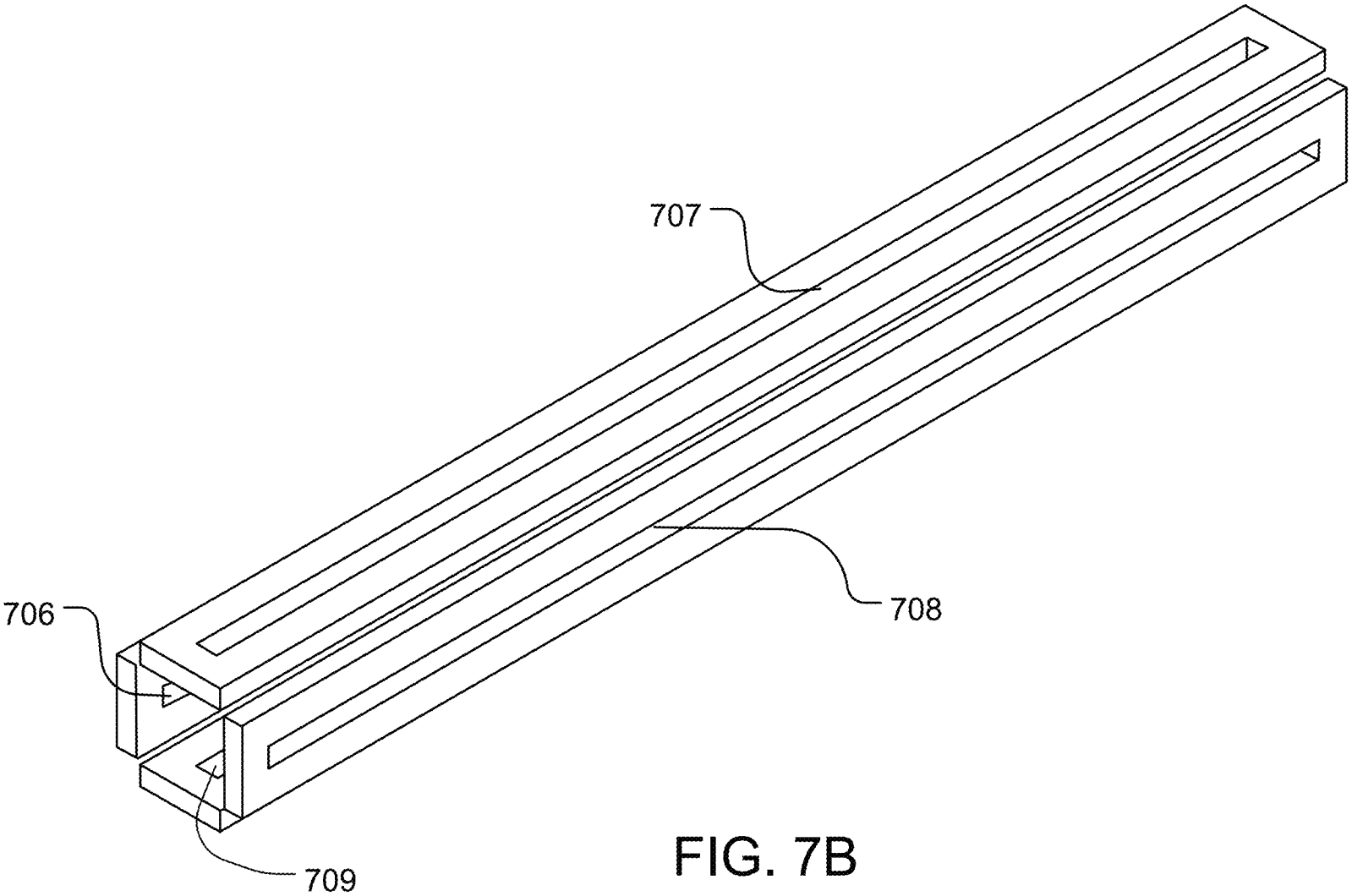
FIG. 7B shows a set of RF electrodes of the assembly of FIG. 7A.
Figure 7C:
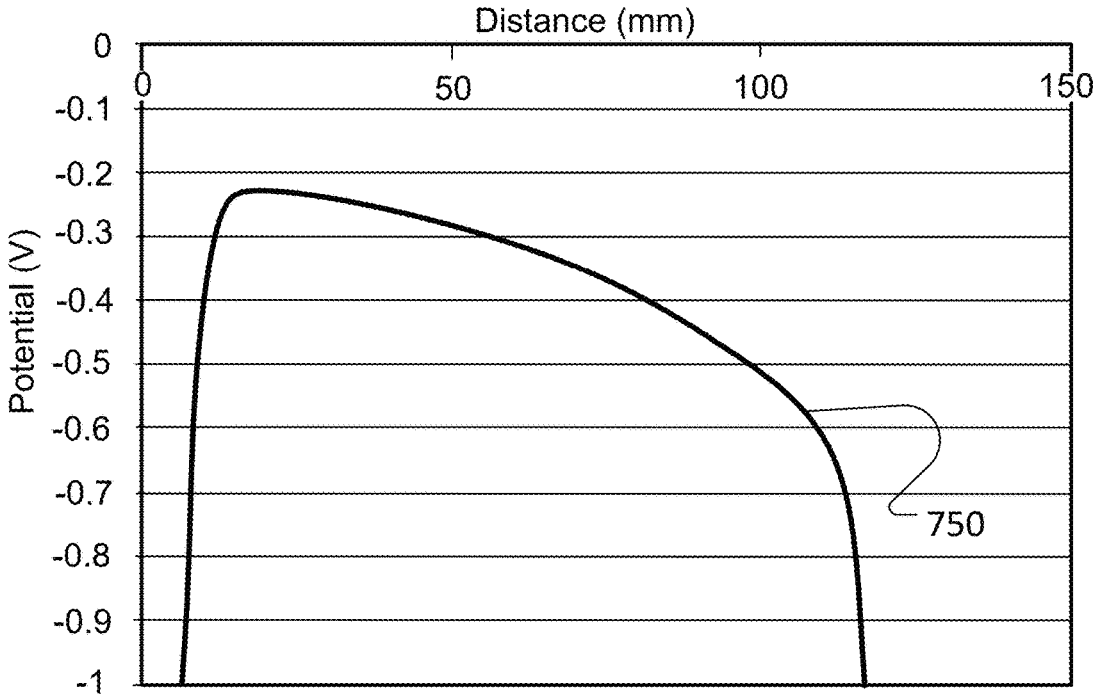
FIG. 7C shows a calculated axial potential distribution of the assembly of FIG. 7A.

An example of an assembly 700 of FIG. 7A is identical to the assembly 400 of FIG. 4A, except that the arrays 411, 412, 413 and 414 of grid wires 415 located within the openings 406-409, respectively, in the assembly 400 of FIG. 4A, are omitted. Consequently, in order to maintain a reasonable approximation of the RF electrodes to solid flat plate electrodes, and, therefore, achieve a reasonable approximation of the RF fields to those produced by solid flat plate electrodes, the openings 706-709 in the RF electrodes 701-704, respectively, are typically reduced in width, as shown schematically in FIG. 7A, compared to the width of the openings 406-409 in RF electrodes 401-404 of FIG. 4A.

For example, a computer model of the embodiment of FIG. 7A was defined, having the same dimensions and applied voltages as the computer model as that described previously for the embodiment of FIG. 4A, except, as shown in FIG. 7A, the arrays of wires were omitted, and the openings 706-709 were reduced in width from the 7.0 mm width of openings 406-409 of FIG. 4A, to a width of 2.2 mm, forming a narrower slot in each RF electrode. The axial potential distribution 750 that was calculated for this model is plotted in FIG. 7C.

The dependence of the axial potential distribution is similar to that found for the embodiment of FIG. 4A. The maximum potential difference along the axis due to the penetration of the auxiliary field through the slots is found to be about 300 mV, reduced from about 500 mV for the model of the embodiment of FIG. 4A. These results suggest the use of a somewhat greater (e.g., a factor of two or so) the auxiliary DC voltage for obtaining the same axial field as with the embodiment of FIG. 4A.

The embodiments described so far rely on field penetration of an auxiliary DC field through openings in RF electrodes, where an axial field in the ion guide is generated by arranging the auxiliary DC electrode geometry to cause the auxiliary DC field to vary along the ion guide axis. However, an axial field can also be generated in an RF ion guide when the auxiliary DC field is kept fixed along the length of the ion guide axis, while the degree of transparency of the openings in the RF electrodes varies along the ion guide length. For example, the openings in the RF electrodes can be characterized by a grid density that indicates the number of wires or grid per unit area. By having a higher number of grids or wires in a portion of an RF electrode, a grid density can be varied along the axis of the RF electrode. This variable RF electrode transparency can be achieved in a number of ways. In some embodiments, an array of grid wires are incorporated similar to the arrangement of FIG. 4A, but spacing between grid wires increases progressively along the length of the ion guide, thereby increasing the RF electrodes' transparency to the DC auxiliary field. Alternatively, an array of variable-spaced openings can be formed by machining slots in the RF electrodes, where the width of the open slots varies monotonically along the ion guide axis. In some embodiments, the transparency of the RF electrodes along the ion guide axis can be generated by providing a continuous slot along the length of the RF electrodes, where the width of the slot varies continuously along the length.

The DC auxiliary electrodes can be provided as four flat plates, similar to those shown in FIG. 4A, but oriented parallel to the RF electrodes. Alternatively, the DC auxiliary electrodes can be provided as a square enclosure, or a cylinder, or any other type of enclosure, provided that the enclosure is conductive and presents the same surface contour to each RF electrodes such that the same DC auxiliary field is developed at most (e.g., all) axial positions between the DC auxiliary electrode and each RF electrode.

Figure 8A:
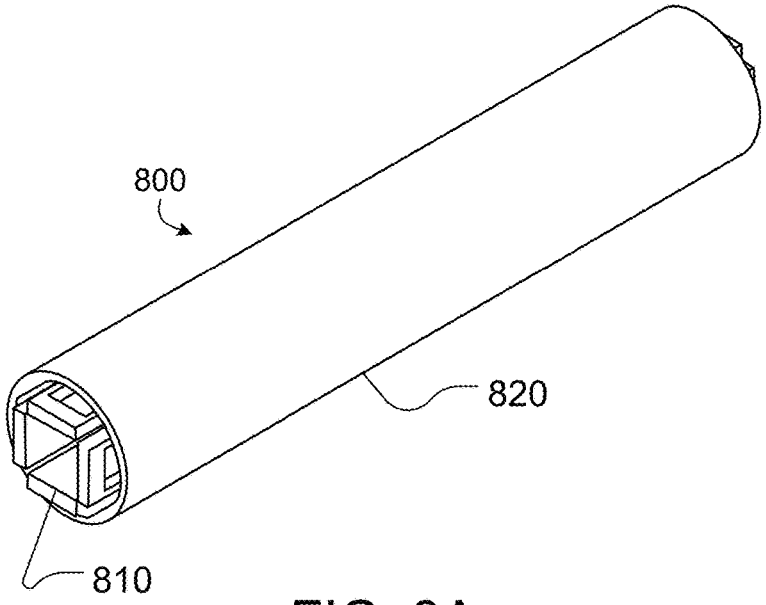
FIG. 8A shows a rectilinear ion guide assembly, having a DC auxiliary electrode configured as a cylinder, and partially-transparent RF electrodes.
Figure 8B:
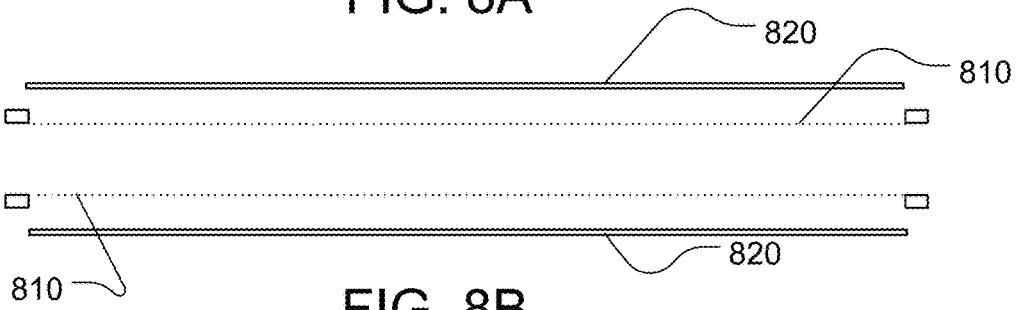
FIG. 8B shows a cross section of the assembly of FIG. 8A.
Figure 8C:
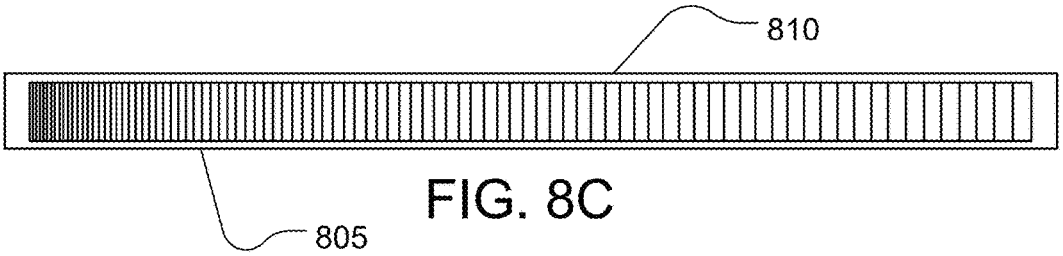
FIG. 8C shows an RF electrode of the FIG. 8A assembly showing the variable transparency is generated by an array of wires with variable spacing along the ion guide length.

An example of such embodiments is an assembly 800 which incorporates arrays of grid wires 805 having variable spacing in RF electrodes 810, and a cylindrical DC auxiliary electrode 820 surrounding the RF electrodes, is illustrated in FIG. 8A.

Figure 8D:
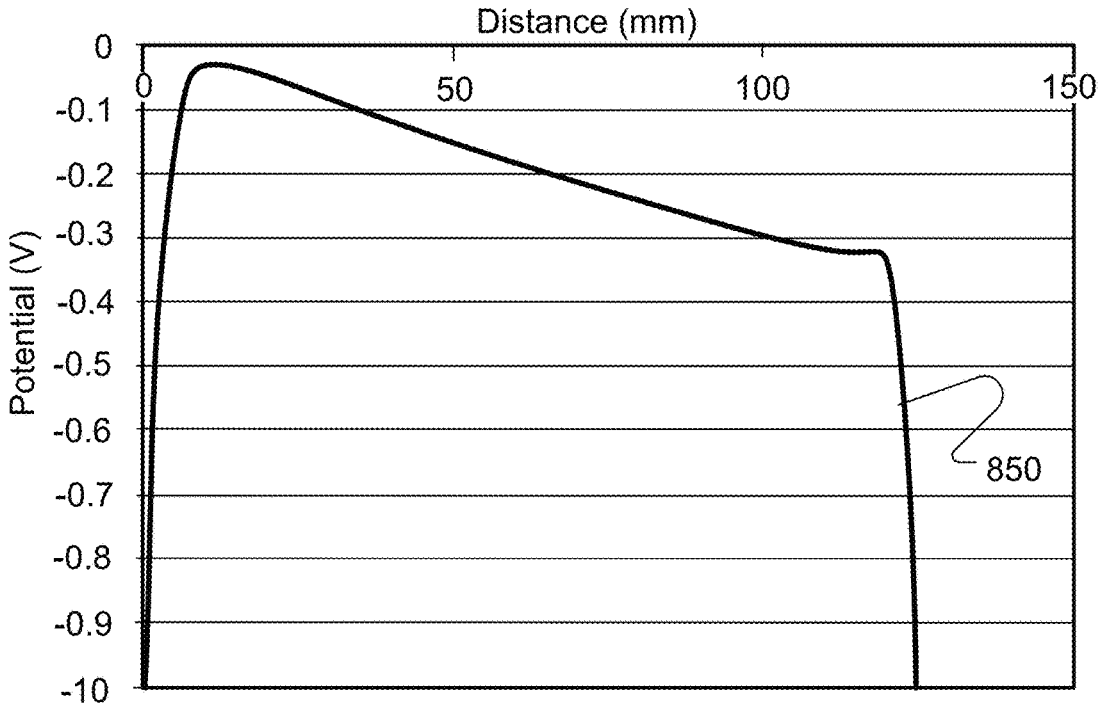
FIG. 8D shows a calculated potential distribution of the assembly of FIG. 8A.

A computer simulation model was designed to demonstrate the axial field produced in this embodiment. In this model, which is not meant to be limiting, the RF electrodes are 9 mm wide by 125 mm long by 2 mm thick, and have openings that are 7 mm wide by 119 mm long, as with the computer model used for the embodiment shown in FIG. 4A. Grid wires used to cover the openings in the RF electrodes were 0.2 mm square cross-section, and were spaced apart with increasing spacing along the length of the ion guide, such that the spaces between grid wires increased from 0.2 mm at the entrance end to 2.0 mm at the exit end. The RF ion guide electrodes 810 were surrounded by an auxiliary DC electrode 820 in the form of a cylinder with an inner diameter of 20 mm. A voltage of 0 V was applied to the RF electrodes 810 and a voltage of −20 V was applied to the cylinder DC auxiliary electrode 820, and the axial potential distribution was calculated. The axial potential distribution 850 is shown in FIG. 8D.

It is evident that the axial field produced by the geometry of FIG. 8A is stronger than those produced by the previous embodiments. For example, the maximum potential difference calculated for the embodiment of FIG. 8A was about 3.0 V with a differential voltage of only 20 V between the DC auxiliary electrode 820 and the RF electrodes 810 voltage offset, compared to 0.5V with a 100 V differential with the embodiment of FIG. 4A. This means that a lower DC auxiliary voltage could be used with the assembly 800 of FIG. 8A to achieve the same axial field magnitude as that obtained in FIG. 4A.

Figure 9A:
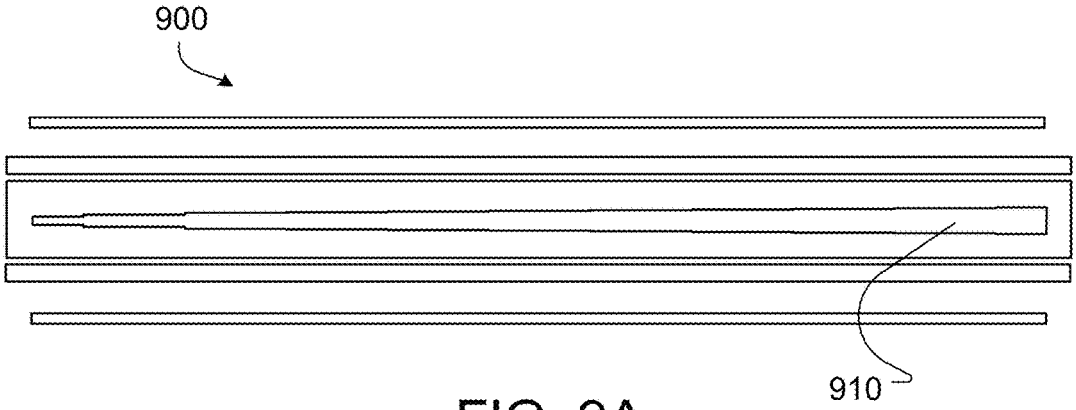
FIG. 9A shows an assembly of a rectilinear ion guide with auxiliary DC electrodes extending parallel to the rectilinear RF electrodes, where the RF electrodes include a slot with a width that varies along the ion guide length.
Figure 9B:
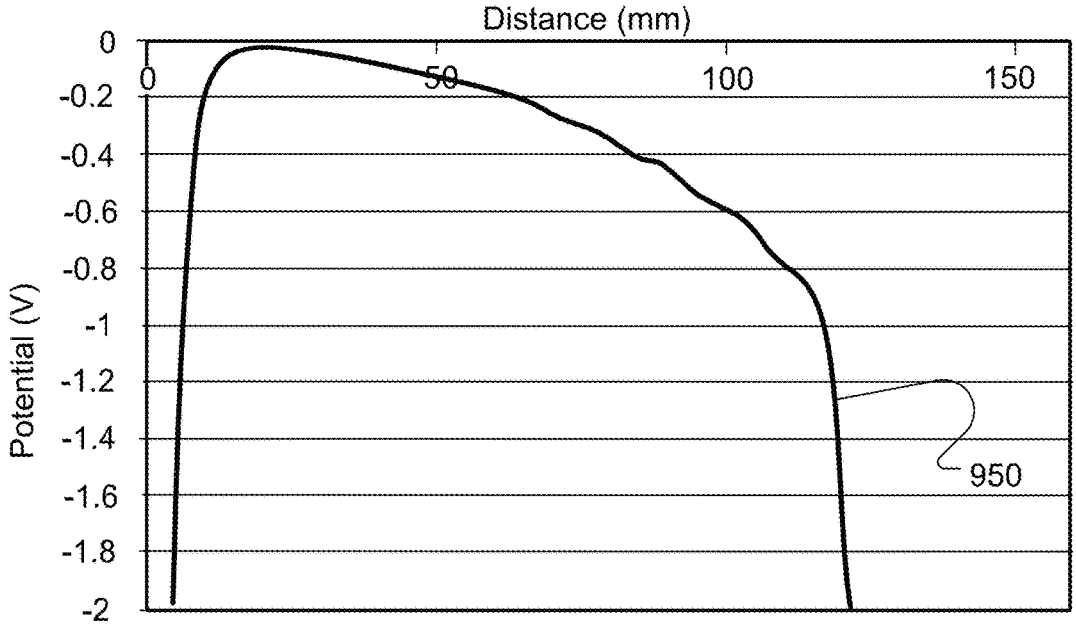
FIG. 9B shows a calculated axial potential distribution for the assembly of FIG. 9A.

As mentioned previously, a variable transparency of the RF electrodes to the DC auxiliary field can also be obtained by incorporating a longitudinal elongated slot in the RF electrodes, which varies in width along the length. The assembly 700 of FIG. 7A was modified such that the 2.2 mm wide, constant width slots in the RF electrodes were changed to an elongated slot 910 having a width that increases from 1.2 mm at the entrance end to about 4.3 mm at the exit end, and the tilted DC auxiliary electrodes of FIG. 7A were made parallel to the RF electrodes, positioned 11 mm from the ion guide axis. The resulting computer model electrode geometry of an assembly 900 is depicted in FIG. 9A, and the calculated axial potential distribution 950 is shown in FIG. 9B.

The resulting axial field exhibits a range of axial potentials of about 750 mV, when the RF electrode offset voltage is 0 V and the DC auxiliary electrode voltage is −100 V.

In some embodiments, variable transparency of the RF electrodes to the auxiliary DC field can be achieved by incorporating slots through the RF electrode which have varying width from one end to the other. This produces a variable auxiliary field penetration through the RF electrodes similar to that resulting from an array of wires having variable spacing, as exemplified in FIG. 8C. An assembly 1000A having RF electrode 1010A with variable slot widths 1011A is shown in FIG. 10A.

Figure 10A:
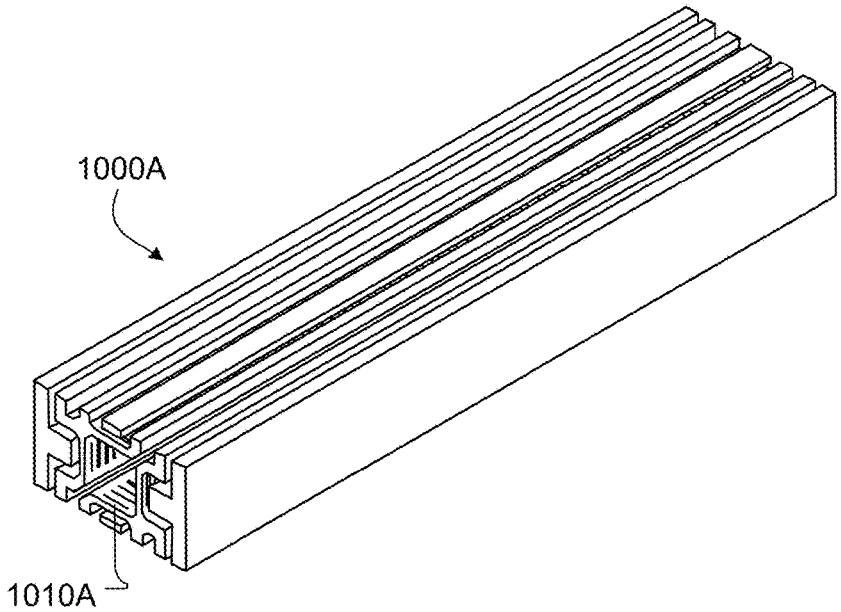
FIG. 10A shows an assembly of RF rectilinear ion guide electrodes and auxiliary DC electrodes that are configured between two flat parallel insulator surfaces, as between two printed circuit boards.

In some embodiments, the RF and DC auxiliary electrodes of a rectilinear ion guide are arranged in such a fashion that all electrodes could be mounted conveniently between two insulator plates arranged in parallel—one plate on top and one on the bottom of the assembly shown in FIG. 10A (The insulator plates are not shown in this FIG. 7A). For example, the assembly 1000A shown in FIG. 10A could conveniently be mounted between two parallel printed circuit boards. The elongated slots 1011A configured in the RF electrodes 1010A increase in slot width, as measured along the ion guide axis, from one end of the ion guide to the other end.

Figure 10B:
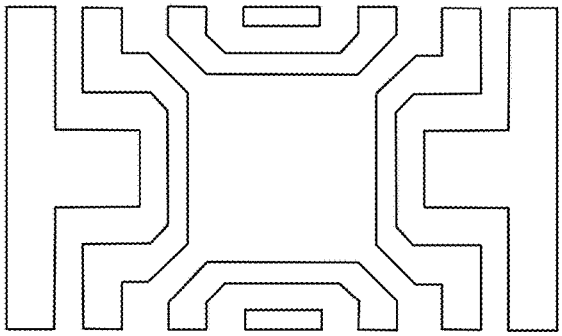
FIG. 10B shows a cross section of the assembly of FIG. 10A.
Figure 10C:
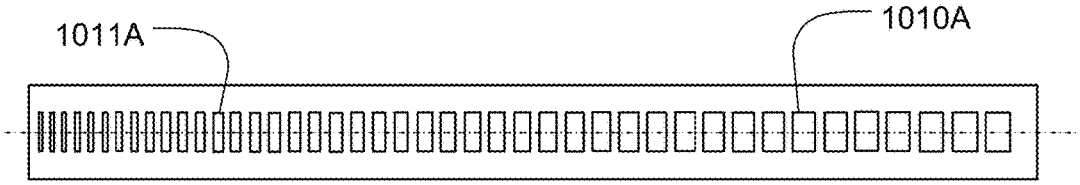
FIG. 10C shows a RF electrode of the assembly of FIG. 10A.
Figure 10D:
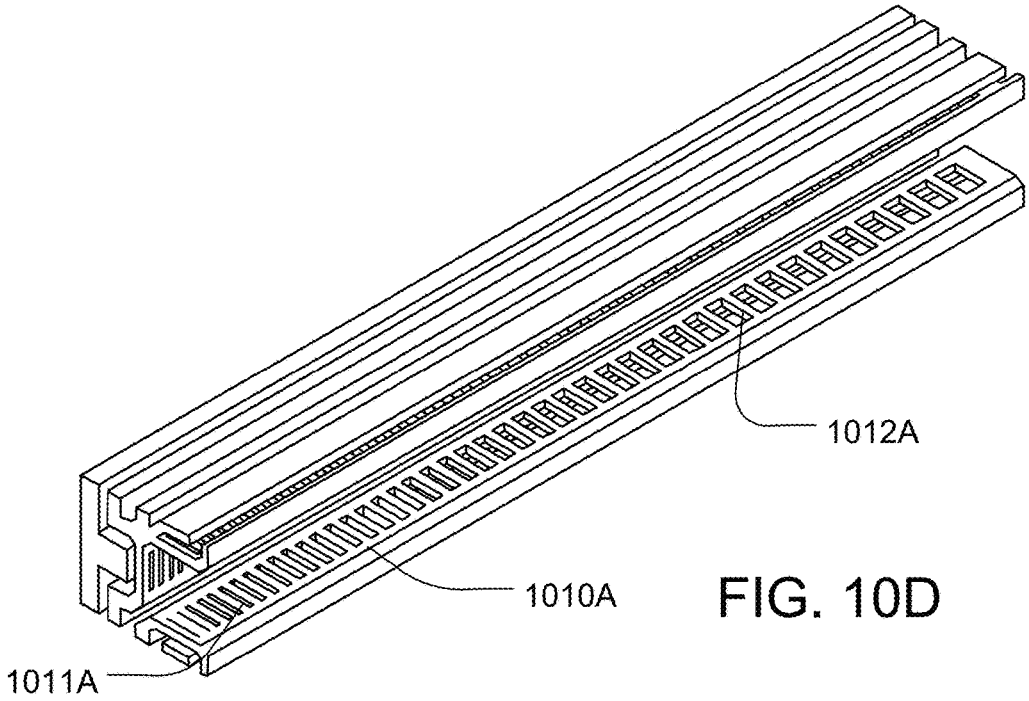
FIG. 10D shows a cut-away view of the assembly of FIG. 10A.
Figure 10E:
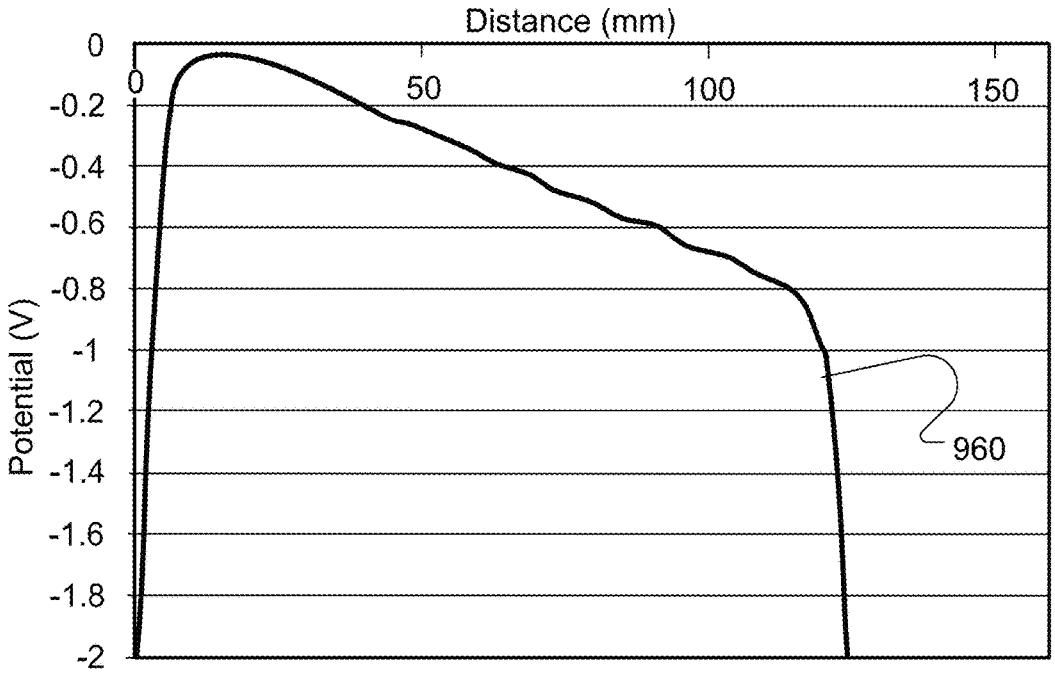
FIG. 10E shows a calculated axial potential distribution of the assembly of FIG. 10A.

An exemplary arrangement was defined as a computer model, in which the RF electrodes are placed 5 mm from the axis, and have a thickness of 1 mm in the radial direction. The DC auxiliary electrode surfaces are placed 7.5 mm from the axis. The slots widths varied from 0.5 mm at one end to 3.3 mm at the other end, and were all 5 mm in their long dimension. The 'ribs' 1012A of RF electrode material separating the slots were all 1 mm thick in the ion guide axis direction. A voltage of −20 V was applied to the four DC auxiliary electrodes and an RF offset voltage of 0 V was applied to the four RF electrodes, and the axial potentials were calculated. The resulting axial potential distribution 960 is shown in FIG. 10B.

A maximum potential difference along the axis is found to be about 750 mV with only 20 V differentials between the RF electrodes and the DC auxiliary electrodes for this example.

In some embodiments, the RF electrodes are round tubes, arranged in parallel in a square pattern. Unlike conventional quadrupole ion guides constructed with round RF electrodes, the round RF electrodes 1110A in an assembly 1100A have slots 1111A machined across the inner portion of their diameter that faces the ion guide axis. The slots 111A are of variable width, increasing in width from one end of the ion guide to the other end. Inside the round tube RF electrodes are mounted round rods 1112A of a diameter that allows sufficient clearance to the inner surfaces of the RF electrode tubes to avoid any shorting or arcing between the rods and the RF electrode tubes. These inner rods are supplied with a DC auxiliary voltage. The difference between the DC auxiliary voltage applied to the rods and the DC offset voltage of the RF voltages applied to the RF electrode tubes, establishes a DC auxiliary field within a space 1113A between the auxiliary rods 1112A and the inner surfaces of the RF electrode tubes 1110A. This DC auxiliary field penetrates through the slots in the RF electrode tubes and influences the axial potential along the ion guide axis. As the slots in the RF electrode tubes increase in slot width along the length of the tubes, the auxiliary field penetration to the ion guide axis varies accordingly, creating an axial field.

Figure 11A:
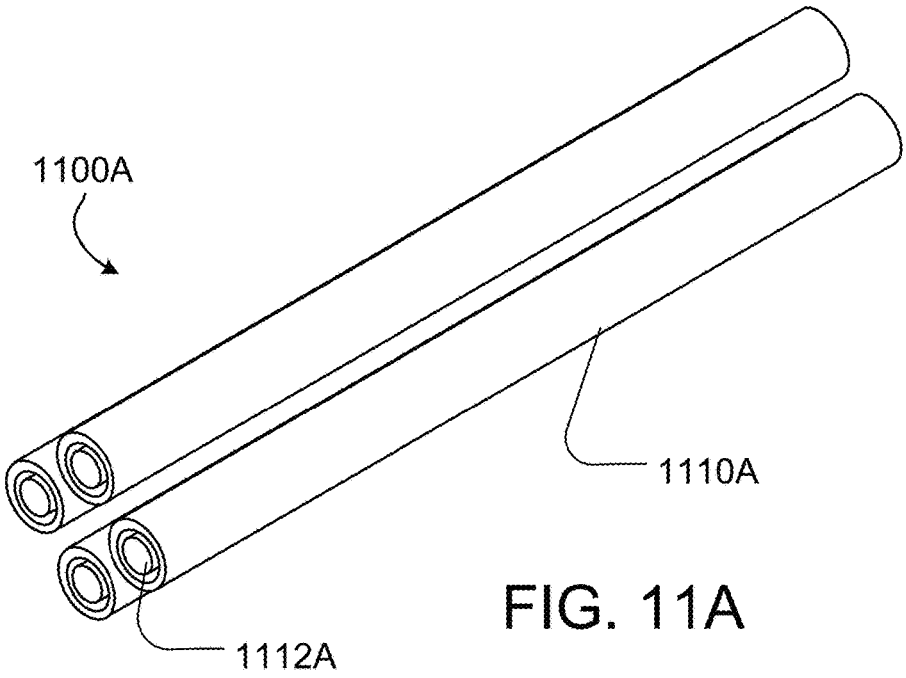
FIG. 11A shows an assembly comprising four round rod hollow cylinders arranged in a conventional RF quadrupole fashion, in which an auxiliary solid rod is positioned concentric within each RF cylinder, where each RF cylinder comprises an array of slots with widths that vary along the ion guide length.
Figure 11B:
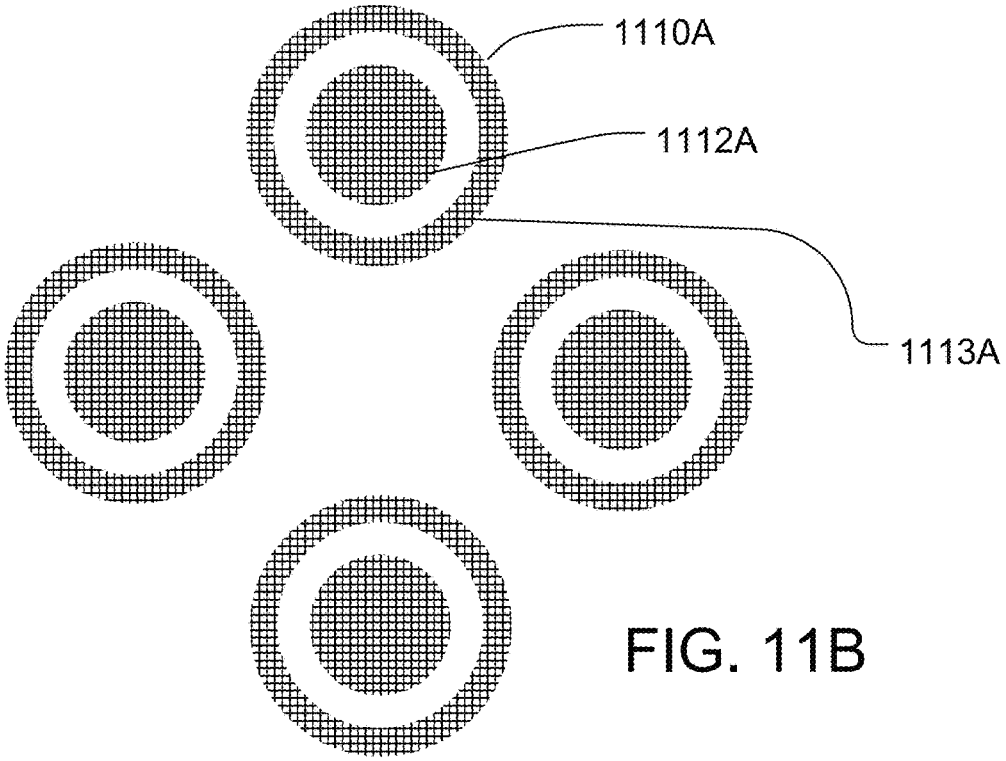
FIG. 11B shows a cross section of the assembly of FIG. 11A.
Figure 11C:
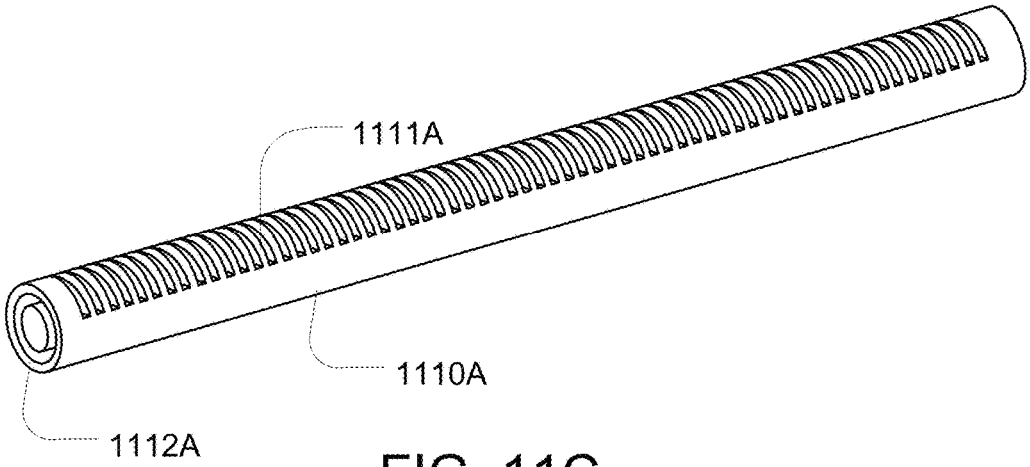
FIG. 11C shows an assembly of one of the RF cylinders and associated DC auxiliary rod.

A specific example of this embodiment is shown as the computer model in FIG. 11A.

In this model, the RF electrode tubes have an outer diameter of 9.25 mm, and are position in a square array, each at a distance of 8.77 mm from the ion guide axis. Their inner diameter is 7.2 mm, allowing a wall thickness of about 1 mm. The DC auxiliary electrode rods have a diameter of 5 mm, allowing a gap of 1.1 mm between the rods and the inner circumference of the RF electrode tubes. The slots in the portion of the RF tubes that face the ion guide axis vary from 0.6 mm at one end to 2.2 mm at the other end, and are separated by a length of tubing that is 1 mm thick along the ion guide axis direction. The slots extend to a depth from the RF electrode rod outer surface of 2.5 mm.

Figure 11D:
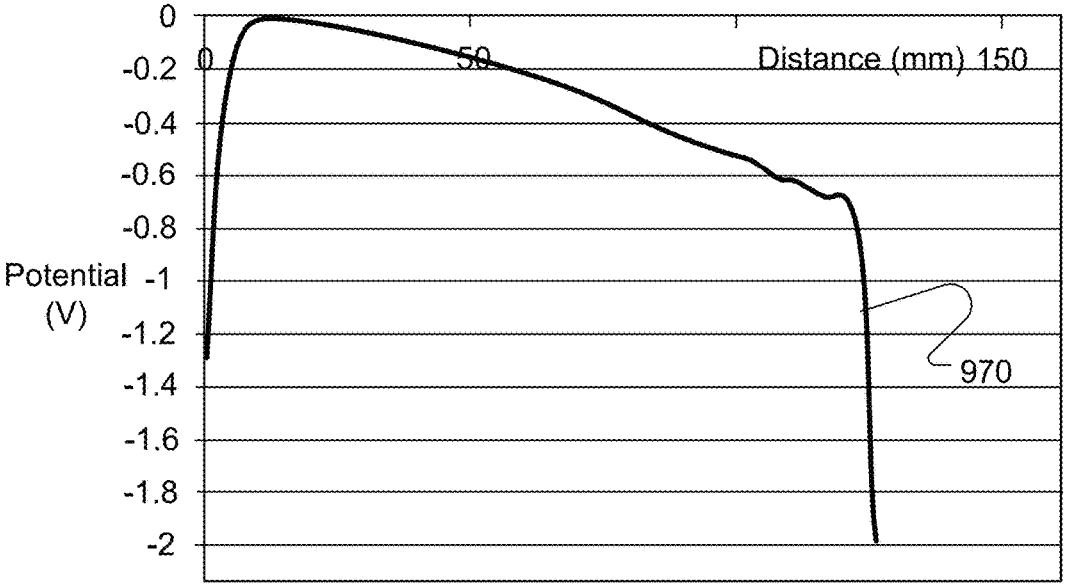
FIG. 11D shows a calculated axial potential distribution of the assembly of FIG. 11A.

An RF offset voltage of 0 V was applied to the RF electrode tubes, and a voltage of −20 V was applied to the DC auxiliary rods. The resulting calculated axial potential distribution is shown in FIG. 11D. It is found that the maximum potential difference along the ion guide axis for this model geometry is about 600 mV or so, for the potential difference of 100 V between the DC auxiliary electrodes and the RF electrodes.

Figure 12A:
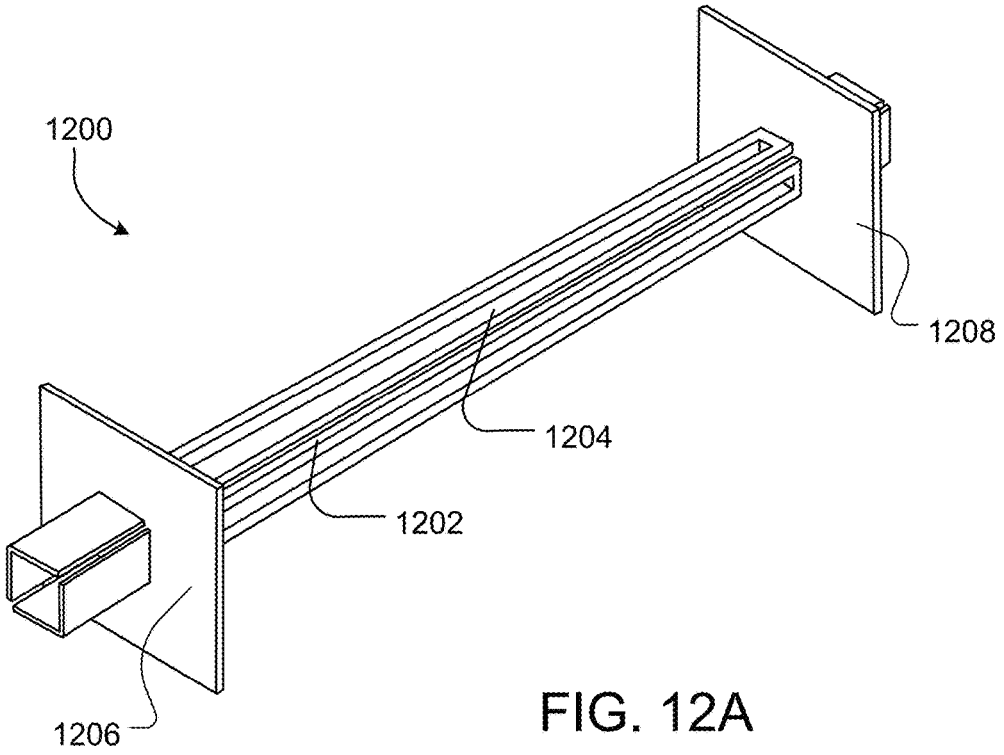
FIG. 12A shows an assembly of a rectilinear ion guide having RF electrodes that are tilted with respect to the ion guide axis, and contains a longitudinal slot of constant width along the length of the electrode.
Figure 12B:
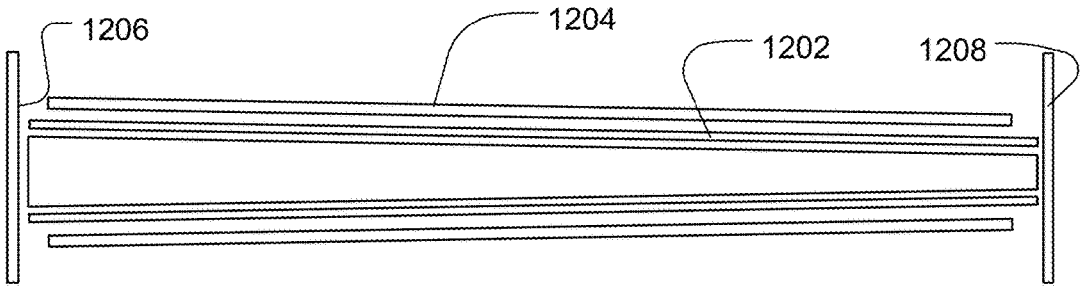
FIG. 12B shows an assembly of FIG. 12A, further showing the tilted DC auxiliary electrodes, each at a constant distance from each respective RF electrode.

FIGS. 12A and 12B show an assembly 1200 in which both an RF electrode 1202 and a DC electrode 1204 have the same tilt angle. Such tilting can produce an axial field even when the RF and DC electrodes 1202 and 1204 are parallel, and the RF electrode 1202 has a constant transparency to the DC field along its axial length. The assembly 1200 also includes an entrance aperture lens 1206 and an exit aperture lens 1208. The assembly 1200 creates an additional effect of increasing RF field intensity due to the RF electrodes being closer together, which tends to further compress the ion beam (i.e., deepening the pseudopotential well) in addition to effects (i.e., energy relaxation) that are due to collision cooling. Alternatively, the DC electrodes 1204 can be tilted by a different angle, which would allow adjustment of the axial field gradient independent of the RF electrode tilt angle. For example, the radial distance to the DC electrode at the exit end can be kept fixed, and the DC electrode tilt angle can be increased by increasing the distance of the DC electrode at the entrance end from the axis. A factor that determines the strength of the impact of the DC voltage on the axial potential is the distance of the DC electrode from the axis, as described above, thus the axial field can may not decrease towards the end of the RF electrode even if the DC electrode is tilted by a smaller amount of the RF electrode.

Figure 12C:
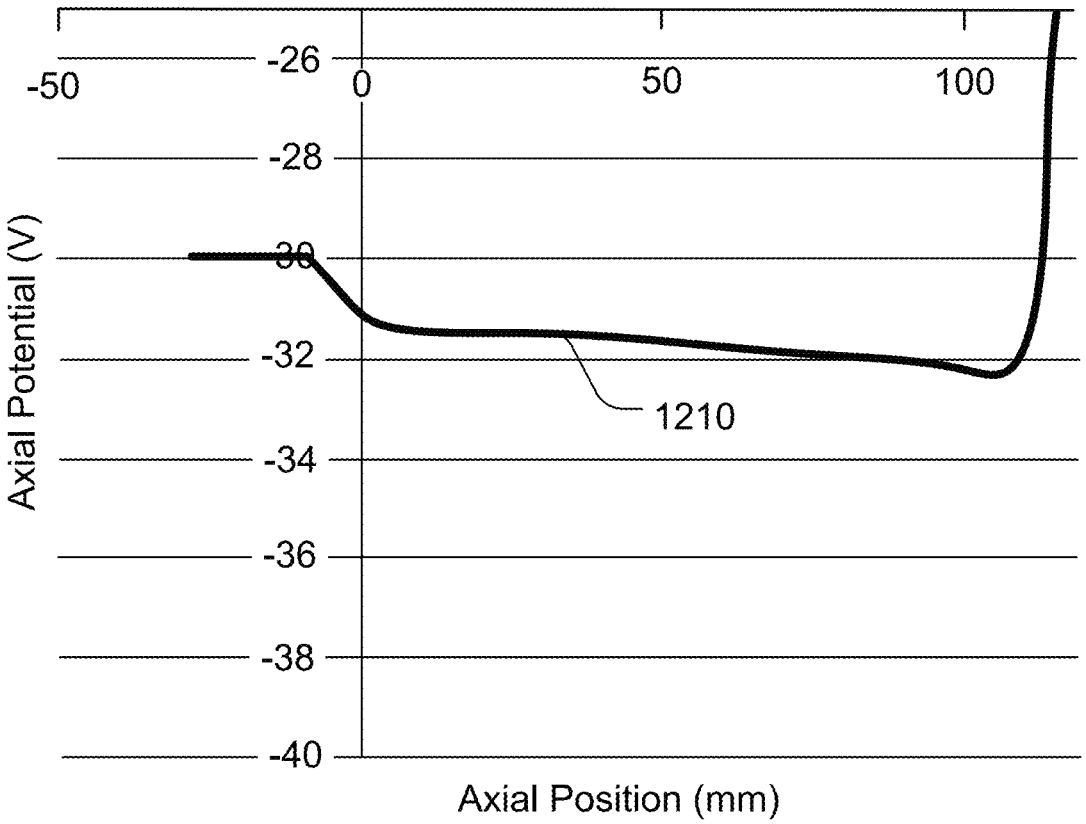
FIG. 12C shows a calculated axial potential distribution of FIG. 12B.

An RF offset voltage of 0 V was applied to the RF electrodes 1202, and a voltage of −500 V was applied to the DC electrodes 1204. The resulting calculated axial potential distribution 1210 is shown in FIG. 12C.

Figure 13A:
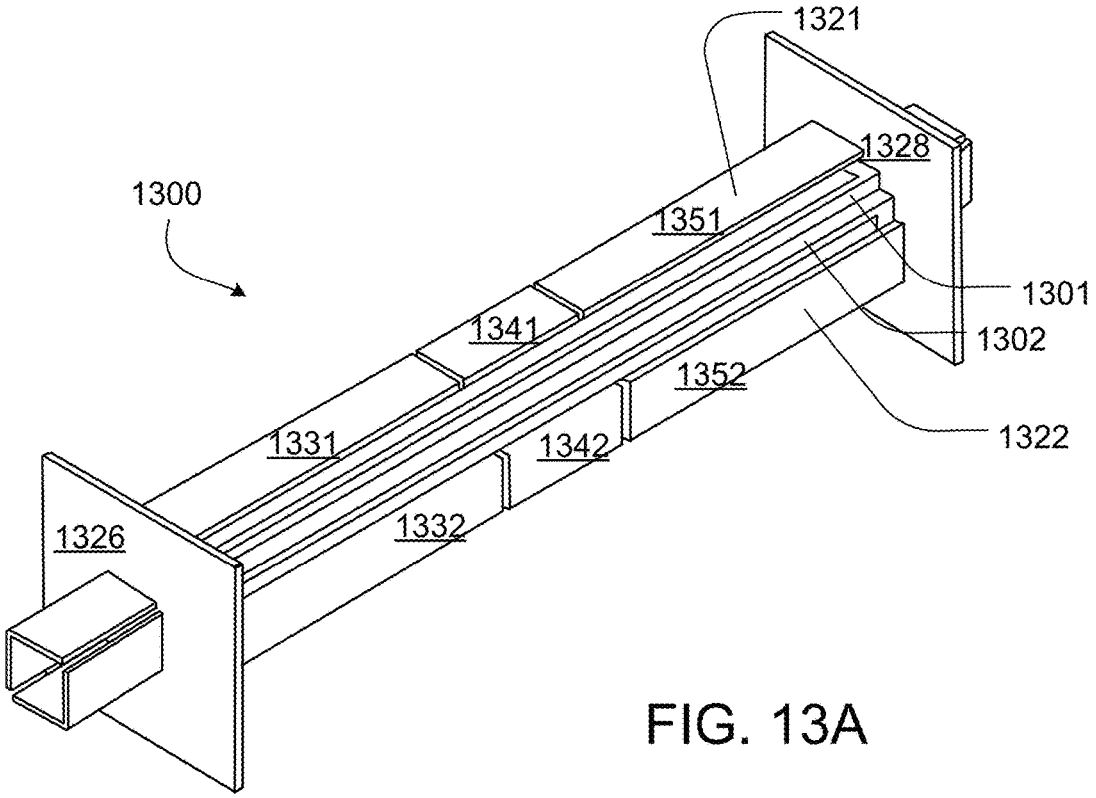
FIG. 13A shows an assembly of a rectilinear ion guide having auxiliary DC electrodes that are segmented into three sections along the ion guide length, essentially creating three regions along the ion guide axis that may have different axial potentials.
Figure 13B:
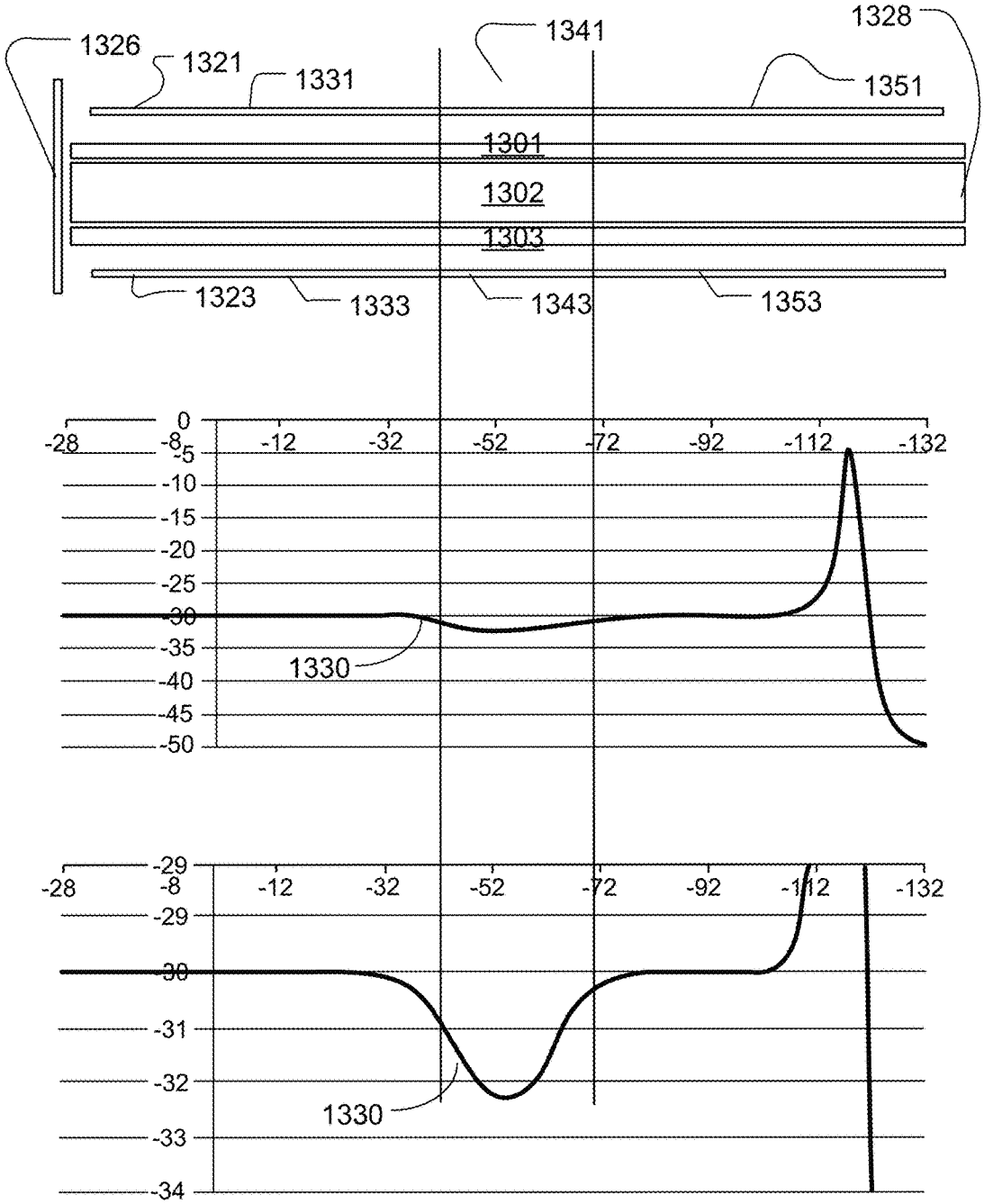
FIG. 13B shows one calculated axial potential distribution possible with the assembly of FIG. 13A.

FIGS. 13A and 13B show an assembly 1300 having an entrance aperture lens 1326 and an exit aperture lens 1328. RF electrodes 1301-1304 (1303 and 1304 are not shown in FIG. 13A) in the assembly 1300 are identical to the RF electrodes 401-404 of FIGS. 4A-4D.]. Four DC electrodes 1321-1324 (1323 and 1324 are not shown in FIG. 13A) in the assembly 1300 that are proximal to the RF electrodes 1301-1304, respectively, are all parallel to the ion guide axis. Each DC electrode 1321-1324 is segmented into three segments: DC electrode 1321 is segmented into an upstream segment 1331, a middle segment 1341, and a downstream segment 1351; DC electrode 1322 is segmented into an upstream segment 1332, a middle segment 1342, and a downstream segment 1352; While not shown in FIG. 13A, DC electrode 1323 is segmented into an upstream segment 1333, a middle segment 1343, and a downstream segment 1353. Also not shown in FIG. 13A is the DC electrode 1324, which is segmented into an upstream segment 1334, a middle segment 1344, and a downstream segment 1354. All upstream segments 1331-1334 are identical and are positioned the same axially, and typically have the same DC voltage applied.

The same is true also for the middle segments 1341-1344, and for the downstream segments 1351-1354, but the DC voltage applied to the upstream segments 1331-1334 may be different from that applied to the middle segments 1341-1334, which may be different from that applied to the downstream segments 1351-1354.

A calculated axial potential distribution 1330 is shown in FIG. 13B. The lowest panel shows a magnified view of the potential distribution 1330, which is obtained when a RF offset voltage of −30V was applied to the RF electrodes, and voltages of −30 V, −500 V, and −30 V were applied to the DC electrodes segments 1331-1334, 1341-1344, and 1351-1354, respectively, and a voltage of 0 V was applied to the exit electrode 1328. The potential distribution 1330 contains a potential well at the location of the middle segments 1341-1344. The potential distribution 1330 shows a "trapping" configuration, where there is no axial potential in either of the first or the last segment. However, ions would nevertheless accumulate within the center local potential well. As shown in the potential distribution 1330, the exit aperture lens 1328 maintains a potential barrier to trap ions within the assembly 1300. In general, many more segments can be provided to produce essentially any desired axial potential distribution, which may generate, for example, multiple local potential wells of the type shown in FIG. 13, as well as increasing and/or decreasing axial potential gradients, and/or regions of no or insignificant axial potential gradients.

Further, by dynamically adjusting the DC electrode segment voltages, the axial potential distributions may be manipulated over time to effect a variety of ion manipulations, such as ion mobility analysis using potential wells that move along the axis over time; trapping different ion species in separate potential wells, then allowing them to coalesce to effect ion-ion interactions, such as Electron Transfer Dissociation. In other words, the electric field generated by the DC electrode can provide a time-dependent moving local potential well within the RF ion guide to control motions of ions along the ion guide axis.

RF electrodes can be segmented as well, in conjunction with the segmented DC electrodes. This allows different RF voltages and/or frequencies, and/or DC offset voltages to be applied to different RF electrode segments, allowing ions to be trapped in local potential wells established by the DC electrode segment voltage distribution. Ions can also be manipulated locally by applying different RF amplitudes and/or frequencies to the RF electrode segments associated with the local DC trap electrodes. For example, to effect resonant frequency excitation of selected m/z ions trapped in the local potential well, without affecting ions in other local potential wells, or to eliminate intense low-m/z ions by increasing the RF amplitude above the stability limits of the low-m/z ions.

Conventional hyperbolic-shaped electrodes have gaps between neighboring hyperbolic electrodes that decrease with increasing distance from the axis. In other words, the gap through which the DC field from DC auxiliary electrodes located between the RF electrodes penetrates decreases, decreasing the effectiveness of such auxiliary DC electrodes for generating an axial potential gradient. This constraint is alleviated for hyperbolic shaped RF electrodes by embodiments of RF ion guides that are configured with RF electrodes that have hyperbolic-shaped surfaces facing the ion guide axis, as is conventional, but where the RF electrodes also include an open space opposite these surfaces in which auxiliary DC electrodes can be located. The hyperbolic-shaped RF electrodes can further include openings that allow the DC fields generated by the auxiliary DC electrodes to penetrate through and modify the electric fields proximal to and along the ion guide axis. The openings in the RF hyperbolic electrodes could be slots with widths that vary along the ion guide axis, similar to those shown in FIG. 11 for round RF electrodes, in order to produce axial potential gradients. The openings could also include meshed, wired, or gridded hyperbolic-shaped electrodes to achieve similar benefits. Further, the auxiliary DC electrodes could be round, as illustrated in the embodiments of FIG. 11 for round RF electrodes, but could just as well be any other elongated shape, such as square rods, wires, etc.

In general, separate DC voltages can be supplied to various DC auxiliary electrodes to counteract any misalignment of the DC electrode with respect to the ion guide axis due to errors caused by mechanical tolerance in the manufacturing process.

Furthermore, the acceleration and deceleration of ions can be changed for any of the above disclosed embodiments, by switching the polarity of the DC electrode relative to that of the ion guide offset voltage. For example, using a positive DC voltage on the auxiliary electrodes, a decelerating axial field can be generated to decelerate positive ions, allowing the ion to have more time to, for example, collide and cool down. In some cases, ions can be stopped by the deceleration field even in the absence of collisions.

The axial deceleration field could be adjusted to stop and turn around ions with axial kinetic energy lower than some value, while only slowing down, but still transmitting, other ions with kinetic energies greater than this value. This approach is advantageous, for example, in discriminating against lower m/z ions having lower kinetic energies in favor of higher m/z ions having greater kinetic energies, which can reduce background noise, chemical interferences, and detection saturation effects in mass spectrometer instruments.

It should be understood that the tilt angle of auxiliary DC electrodes in various embodiments could be either positive or negative with respect to the ion guide axis, with the corresponding DC voltage polarity chosen accordingly to effect the desired axial potential gradient. For example, the embodiments described so far with tilted auxiliary electrodes are shown with a decreasing distance of the DC electrodes from the ion guide axis from the entrance end to the exit end, with negative DC voltages with respect to the RF offset voltage of the RF electrodes, and for positive ions, in order to create an accelerating axial field. However, a similar accelerating axial field can also be created by tilting the auxiliary DC electrodes with the opposite tilt angle, where the distance of the DC electrodes increases from the entrance end to the exit end, and a positive relative DC voltage is applied to the DC electrodes.

Instead of a RF ion guide having elongated parallel rod electrodes, a 'stacked ring' ion guide that includes a series of many thin plates, all having a central hole along an axis, electrically insulated and stacked together, can be used. RF voltage is applied between every neighboring electrode in the stacked ring ion guide, setting up an RF field near an inner diameter of the thin plates, which repels ions coming close to the inner diameter, thereby acting as an ion guide. When a collision gas is present, the ions can cool from collisions, and condense along the axis with only thermal energies. The ions can be moved along the axis by superimposing a 'traveling potential wave' along the axis. Such a device can also be used as an ion mobility separator, due to the different responses of ions having different mobilities in an electric field in a gaseous environment.

The methods and apparatus disclosed herein can also be used to provide such a traveling wave potential. DC electrodes configured as a series of closely spaced rings can be used to carry the electrical traveling wave, while the RF electrodes can continue to provide the RF ion guiding fields. This arrangement provides an easier configuration that does not involve superimposing two oscillatory voltages on the same electrodes. Additionally, deeper and narrower pseudo-potential RF potential well can be obtained when a separate DC electrode is used to generate the electrical traveling wave. In some embodiments, the DC electrode can be fabricated, for example, in the form of hollow cylinders using a resistive glass material, where the resistive glass hollow cylinder surrounds the semi-transparent RF electrodes of various types as described for the embodiments above. A DC potential can be applied between the ends of a hollow cylinder to set up a potential gradient within the cylinder. Such cylinders may be used as a time of flight (TOF) reflectron mirror. Such resistive DC electrodes having a voltage gradient can be used to directly provide an axial field without tilting the DC electrode with respect to the RF electrode. Alternatively, other resistive electrodes used for the auxiliary non-tilted DC electrodes can include providing a resistive film on an insulator to obtain an axial field when a DC potential is applied across two portions of the resistive film.

Additionally many of the described embodiments can be modified such that the auxiliary DC electrode forms a continuous enclosure, for example, as is shown in FIG. 8A. In this way, the DC electrode can also serve as a gas container for collisional gases used for collisional cooling within the RF electrode.

In general, all of the assemblies disclosed herein can be incorporated in an exit region of a high pressure collision cell. In this way, the axial field in the assemblies can be used to direct ions out of the high pressure collision cell, thereby avoiding ion stagnation within the collision cell, and/or providing a trapping region at the exit end. Furthermore, the entrance and exit aperture lenses (as shown in FIGS. 12 and 13, for example) can be used with or without pulsed voltages. When used without pulsed voltages, ions can be introduced continuously through the entrance aperture lens into the assembly and can be continuously directed out of the assembly. When used with pulsed voltages, the ions can be trapped within the cell, optionally processed while trapped, which may include additional collision cooling, resonant frequency fragmentation, ion-ion reactions, etc. then released and rapidly directed out of the assembly. Such trapping and rapid releasing also allow greater sensitivity due to better duty cycle efficiency, such as when coupled to an orthogonal TOF analyzer.

In all embodiments of the subject invention, incorporated aperture lenses may be conventional apertures that include a single electrode having an aperture centered on the ion guide axis, or may instead include an RF aperture, as described above and in co-pending application Ser. No. 14/292,920, the disclosures of which are fully incorporated herein by reference. An example of such an RF aperture is included in the embodiment illustrated in FIGS. 16A-E. FIG. 16A shows an end-on view of an RF aperture 1600 configured as four planar electrodes 1601-1604, each having a thickness of about 1 mm, and arranged to form a square aperture 1605 with edge dimension 1606 of 3 mm, centered on the ion guide axis. Electrodes 1601 and 1602 are electrically connected together, forming electrode pair 1601/1602, and electrodes 1603 and 1604 are also connected together, forming electrode pair 1603/1604. An RF voltage can be applied between electrode pairs 1601/1602 and 1603/1604, thereby forming an RF field within the central aperture 1605. The RF voltage may be referenced to a DC offset voltage, which partly determines the potential on the ion guide axis in the vicinity of the RF aperture 1600.

In FIGS. 16B and 16D, the RF aperture 1600 is shown in cross-section positioned between two co-axial rectilinear ion guides 1607 and 1608, each having an axial field. FIG. 16B shows the exit region of upstream rectilinear ion guide 1607, which includes RF electrode pair 1613 and 1614 (the orthogonal electrode pair is not visible in this cross-section view), as described above for the ion guide shown in FIG. 4. Ion guide 1607 also includes an auxiliary electrode associated with each RF electrode. In the cross-section view of FIG. 16B, auxiliary electrodes 1612 and 1611 are associated with RF electrodes 1613 and 1614, respectively. In contrast to the embodiment displayed in FIG. 4A, which included auxiliary electrodes 421-424 having a rectangular cross-section, the auxiliary electrodes 1612 and 1611 (and the auxiliary electrodes not shown corresponding to the orthogonal RF electrodes not shown) are round rods having a circular cross-section with a diameter of 2 mm, and a tilt angle with respect to the ion guide axis of 2 degrees.

The downstream ion guide 1608 is configured similar to ion guide 1607, with RF electrodes 1621 and 1620 and corresponding orthogonal RF electrodes (not shown), and associated auxiliary electrodes 1618 and 1619, respectively, and corresponding orthogonal auxiliary electrodes, respectively (not shown), at a tilt angle of 1 degree with respect to the ion guide axis. The radial distance 1617 between the opposing RF electrodes of an RF electrode pair in ion guides 1607 and 1608, such as between RF electrodes 1613 and 1614, and between 1621 and 1622, was 6 mm, that is, about twice the aperture dimension 1606 shown in FIG. 16A.

Trajectory calculations for 12 ions were performed, which were launched into the upstream entrance of ion guide 1607, not shown in FIG. 16B. In the trajectory simulations, ion collision cooling is simulated as hard-sphere collisions between the ions and background gas molecules. For the simulation depicted in FIG. 16B, the ions were taken to be reserpine ions with a mass/charge of 609. The background gas was assumed to be nitrogen molecules of mass/charge 28 at 273 K temperature, and the corresponding collision cross-section was taken to be $2.2\times10^{-18}$ $m^2$. The background gas pressure within ion guide 1607 was taken to be 26.7 millibar. Although the ions had reached thermal equilibrium with the background gas early in their passage through ion guide 1607, the axial field imposed by the DC voltage of −500 V applied to auxiliary electrodes 1611 and 1612 and the corresponding orthogonal auxiliary electrodes (not shown) ensured that the ions' axial motion did not become dominated by random motion, but proceeded continuously downstream. By the time the ions had reached the field of view corresponding to FIG. 16B, the kinetic energy of the ions had equilibrated with the background gas, and the radial distribution of the ions' trajectories 1615 had reduced to a maximum radius of about 0.13 mm, as illustrated in region 1616 of FIG. 16B.

In the simulation shown in FIG. 16B, the RF voltage applied to the RF electrodes 1613/1614 and the corresponding orthogonal electrodes (not shown) was 600 V peak-to-peak and the DC offset voltage for these electrodes was 18 V. The RF voltage applied to the electrodes 1601-1604 of RF aperture 1600 was 0 V, and the DC offset voltage was 13 V. In other words, the RF aperture 1600 was modeled in the simulation of FIG. 16B as a conventional DC aperture without any RF being applied. It is apparent that the radial distribution of the ions increases as a consequence of passing through the fringe fields in the proximity of the aperture 1600 in FIG. 16B. In this demonstration, however, the subsequent ion guide 1608 is operated at lower background gas pressure by virtue of the differential pumping between regions 1616 and 1622, and the background gas pressure is taken to be 0 millibar in ion guide 1608 region 1622, essentially simulating a background gas pressure low enough that collisions between ions and background gas molecules are essentially negligible. Therefore, the increased radial distribution of ions (and the radial velocity distribution of ions) resulting from ions passing through the RF fringe fields in the proximity of aperture 1600 operated as a conventional aperture with a DC bias voltage applied, persists as ions traverse ion guide 1608 and beyond within a low pressure vacuum where collisions with background gas are negligible. FIG. 16C shows in end-on view within a short length of ion guide 1608, the trajectories of 50 ions calculated using the same parameter values as for the trajectory calculations of FIG. 16B. The edge dimension 1623 of the square cross-section view of FIG. 16C is 2 mm, indicating that the radial extent of the trajectories in this region 1622 is about 1 mm in diameter. The radial velocity distribution of the ions has also increased.

FIG. 16D shows the same geometry as FIG. 16B, and trajectory calculations using the same parameter values as for the calculations of FIG. 16B, except that the RF voltage applied to the aperture 1600 is now 200 V, peak-to-peak instead of 0 V. There now appears to be no discernable increase in the radial distribution of ions' trajectories 1624 (or their radial velocity distributions) as the ions traverse the region proximal to the aperture 1600. FIG. 16E shows the same end-on view for the calculations of FIG. 16D as FIG. 16C showed for the calculations of FIG. 16B. The radial extent of the trajectories in this region 1622 is now about 0.25 mm in diameter, essentially the same as for the collision cooled ions in region 1616. This demonstrates that an RF voltage applied to an RF aperture 1600 reduces or eliminates the scattering effect of fringe fields encountered in the vicinity of conventional DC apertures separating RF ion guides. This advantage of an RF aperture relative to a DC aperture (that is, conventional apertures without RF voltages applied) is of particular importance when the downstream ion guide operating in collision-free vacuum pressures is interfaced to subsequent focusing optics deployed to transfer the ions into a mass analyzer (such as an orthogonal pulsing time-of-flight mass analyzer), the performance of which depends on the radial and velocity distributions of the ions.

Figure 14:
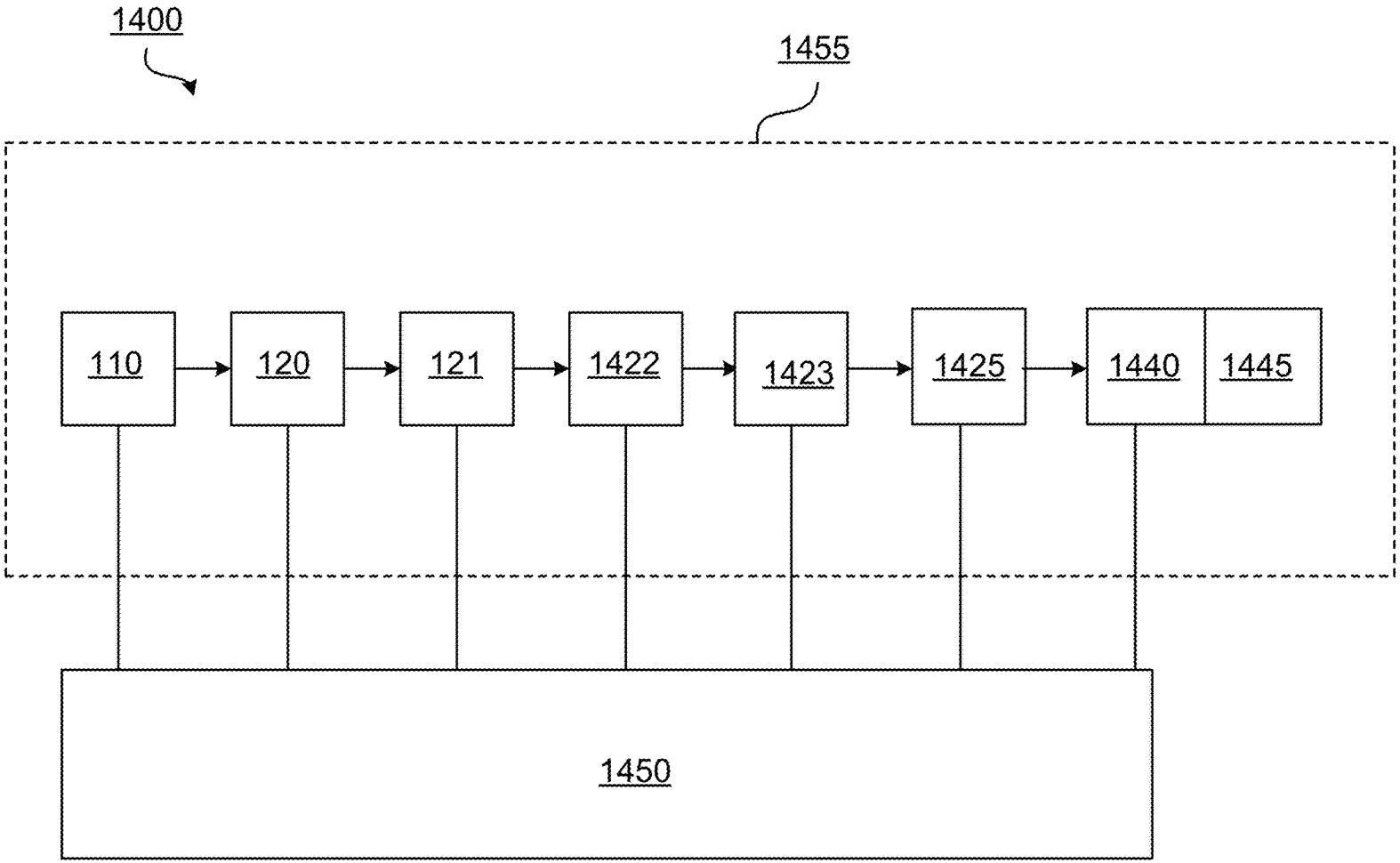
FIG. 14 shows a schematic diagram of a triple-quad mass spectrometer system.

FIG. 14 illustrates a so-called 'triple-quad' mass spectrometer 1400 for MS/MS analysis. The description of the front portion is essentially the same as was described above for FIG. 1, including the vacuum system 1455, system electronics 1450, ion source 110, ion transport assembly 120, and mass analyzer 121, which in this embodiment would be a quadrupole mass filter. In operation, ions having a particular m/z value, or small range of m/z values, are passed through the quadrupole mass filter 121, and are transported by ion transport assembly 1422, (which may include, e.g., one or more RF multipole ion guides, and/or electrostatic focusing lenses and/or apertures, and/or deflectors) to collision cell 1423. Collision cell 1423 includes any of the embodiments described above of an RF multipole ion guide assembly having an axial field. Collision cell 1423 also includes means for containing a background pressure of collision gas, such as nitrogen or argon, sufficient for causing collisions between ions and the collision gas molecules. The gas containment means could be a separate enclosure, or the auxiliary DC electrodes may be configured as the gas containment means, as described previously, for example, in conjunction with the embodiment of FIG. 8. In operation, the ions with m/z values selected by quadrupole mass filter 121 are accelerated into the collision cell 1422 to kinetic energy sufficient to effect collision-induced dissociation (CID) fragmentation. The resulting fragment ions as well as any remaining unfragmented ions continue to experience collisions with collision gas molecules, resulting in collision cooling. The axial field within the RF ion guide of collision cell 1422 ensures rapid transport of the cooled ions to the collision cell exit. They are then transported via ion transport assembly 1425 (which may include, e.g., one or more RF multipole ion guides, and/or electrostatic focusing lenses and/or apertures, and/or deflectors) to quadrupole mass filter 1440. The quadrupole mass filter 1440 m/z analyzes the incoming ions, and m/z filtered ions are passed to detector 1445, which produces an output signal that is then recorded.

It should also be understood that any of the embodiments of RF ion guide assemblies can be configured as a linear ion guide assembly, as depicted in the embodiments described above, or, alternatively, any of the RF ion guide embodiments can be configured as a curved RF ion guide, having curved electrodes and a curved axis along which ions travel. In this case, the axial field is generated in such embodiments along the curved ion guide axis.

Certain embodiments have been described. Other embodiments are in the following claims.

The invention claimed is:

1. An apparatus, comprising:

an ion source;

a mass analyzer;

a RF ion guide positioned in an ion path between the ion source and the mass analyzer, the RF ion guide having an ion guide axis extending between an input end of the RF ion guide and an exit end of the RF ion guide, the RF ion guide comprising:

a first rectilinear electrode extending along the ion guide axis, the first electrode configured to be connected to a voltage source, and a second rectilinear electrode extending along the ion guide axis, the second electrode configured to be connected to a RF source, a portion of the second electrode being positioned between the first electrode and the ion guide axis, the second electrode defining a longitudinal elongated slot extending through a plane of the second electrode, wherein during use of the apparatus, the RF ion guide produces RF electric fields within a central portion of the RF ion guide throughout a region between the second electrode and the ion guide axis to radially confine ions, wherein the first electrode comprises a first face and a second face adjacent to the first face, the first face and the second face extending parallel to the ion guide axis, the first face having a greater surface area than the second face, the first face disposed beyond the plane of the second electrode and facing the ion guide axis, wherein the first and second electrodes are configured so that during operation of the apparatus, a DC electric field is generated between the first and second electrodes to provide a DC electric field at the ion guide axis that has a non-zero axial component throughout at least a portion of the length of the RF ion guide.

2. The apparatus of claim 1, wherein the slot varies in width along a length of the slot.

3. The apparatus of claim 2, wherein the slot increases in width from a first longitudinal end of the slot to a second longitudinal end of the slot.

4. The apparatus of claim 3, wherein the first longitudinal end of the slot is proximal to the input end of the RF ion guide, and wherein the second longitudinal end of the slot is proximal to the exit end of the RF ion guide.

5. The apparatus of claim 1, wherein the first electrode is parallel to the second electrode.

6. The apparatus of claim 1, further comprising one or more additional first electrodes and one or more additional second electrodes, wherein each additional first electrode extends along the ion guide axis and is configured to be connected to the voltage source; and wherein each additional second electrode extends along the ion guide axis, is configured to be connected to the RF source, and defines a respective additional longitudinal elongated slot, and wherein during use of the apparatus, the additional second electrodes produce RF electric fields within the central portion of the RF ion guide throughout the region between the second electrode and the ion guide axis to radially confine the ions.

7. The apparatus of claim 6, wherein, for each additional second electrode, the respective slot varies in width along a length of the slot.

8. The apparatus of claim 6, wherein each additional first electrode is parallel to a corresponding one of the additional second electrodes.

9. A method, comprising:

ionizing a sample to generate ions;

providing background gas along at least a portion of a RF ion guide;

introducing at least a portion of the ions through an input end of the RF ion guide to collide with background gas in the RF ion guide;

providing a DC electric field along an ion guide axis of the RF ion guide that has a non-zero axial component to cause ions that have undergone collisions to move through the RF ion guide toward a ion guide exit end;

wherein providing the axial electric field comprises applying a DC voltage to a plurality of first electrodes of the RF ion guide that surrounds a plurality of second electrodes of the RF ion guide, each extending along the guide axis, such that an electric field produced by the plurality of first electrodes penetrates respective central portions of the plurality of second electrodes before impinging on the ion guide axis to generate a DC electric field between the plurality of first electrodes and the plurality of second electrodes, the central portions of the plurality of second electrodes defining respective longitudinal elongated slots, and wherein the RF ion guide produces RF electric fields within a central portion of the RF ion guide throughout a region between the plurality of second electrodes and the ion guide axis to radially confine at least a portion of the ions that have undergone collisions;

providing a first trapping region proximal to the ion guide exit end, wherein at least a portion of the radially confined ions are trapped following their passage through the RF ion guide;

releasing trapped ions from the first trapping region; and mass analyzing the released ions.

10. The method of claim 9, wherein each of the slots varies in width along a length of the slot.

11. The method of claim 10, wherein each of the slots increases in width from a first longitudinal end of the slot to a second longitudinal end of the slot.

12. The method of claim 11, wherein, for each of the slots, the first longitudinal end of the slot is proximal to the input end of the RF ion guide, and wherein the second longitudinal end of the slot is proximal to the exit end of the RF ion guide.

13. The method of claim 9, wherein each electrode of the plurality of first electrodes is parallel to a corresponding electrode of the plurality of second electrodes.

14. The method of claim 9, further comprising:

selecting a range of mass-to-charge values from said ions with a mass analyzer before introducing at least a portion of the mass-to-charge selected ions through an input end of a second RF ion guide to collide with background gas in the second RF ion guide.

15. The method of claim 9, wherein providing background gas along at least a portion of the RF ion guide comprises providing a background gas pressure high enough that collisions between at least the portion of the ions and background gas results in collision cooling of at least the portion of ions.

* * * * *